US006342689B1

(12) United States Patent
Ishigaki et al.

(10) Patent No.: US 6,342,689 B1
(45) Date of Patent: Jan. 29, 2002

(54) HEAT DEVELOPING METHOD FOR HEAT DEVELOPABLE IMAGE RECORDING MATERIAL

(75) Inventors: Kunio Ishigaki; Takashi Naoi, both of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/549,561

(22) Filed: Apr. 14, 2000

(30) Foreign Application Priority Data

Apr. 14, 1999 (JP) ..... 11-106881
Apr. 22, 1999 (JP) ..... 11-114737
Jul. 9, 1999 (JP) ..... 11-196276

(51) Int. Cl.[7] ..... H05B 1/00

(52) U.S. Cl. ..... 219/216; 219/469; 219/470; 399/285; 399/286; 347/154

(58) Field of Search ..... 219/216, 469–471; 118/60; 430/350, 353; 347/154; 399/285, 286

(56) References Cited

U.S. PATENT DOCUMENTS 3,629,549 A * 12/1971 Svendsen ..... 219/216
4,518,845 A 5/1985 Svendsen et al.

FOREIGN PATENT DOCUMENTS

EP 0476694 A2 3/1992
EP 864944 * 9/1998
EP 476694 * 3/1999
EP 899613 * 3/1999
EP 902322 * 3/1999
WO WO9320480 10/1993
WO WO9530934 11/1995

* cited by examiner

*Primary Examiner*—Teresa Walberg
*Assistant Examiner*—Shawntina T Fuqua

(57) ABSTRACT

A heat developing method conveying, to make a heating processing on a heater surface, a heat developable image recording material is disclosed in which an image forming layer and a protection layer are formed using a polymer latex as a binder on one side of a support made prepared by subjecting a polyester biaxially drawn and crystallized with orientation to a thermal relaxation processing at a temperature equal to or higher than 130° C. and equal to or lower than 200° C. at a conveyance tension of 7 kg/cm$^2$ or lower and in which a back layer is formed using a polymer latex as a binder on the other side of the support, the method comprising the steps of: preparing at least two heaters for providing heating processing at a prescribed temperature to the heat developable image recording material disposed securely in line in a conveyance direction of the heat developable image recording material; conveying the heat developable image recording material with a conveying means by sliding the heat developable image recording material on surfaces of the heaters; and thermally processing the heat developable image recording material by pressing at least a part of the heat developable image recording material during conveyance with a pressing means against the surfaces of the heaters.

17 Claims, 1 Drawing Sheet

HEAT DEVELOPING METHOD FOR HEAT DEVELOPABLE IMAGE RECORDING MATERIAL

FIELD OF THE INVENTION

The present invention relates to a heat developing method for heat developable image recording material and, more particularly, to a heat developing method for heat developable image recording material for photomechanical processes. More specifically, the present invention relates to a heat developing method for heat developable image recording material for scanners or image setters.

BACKGROUND OF THE INVENTION

As one of the light exposure methods of photographic photosensitive materials, there has been known an image forming method of so-called scanner type, in which an original image is scanned and which a silver halide photographic material is light-exposed based on the obtained image signals to form a negative or positive image corresponding to the image on the original image.

As for a case where an image output from a scanner on a film is further printed directly on a printing plate without any reversal step, or a scanner light source having a soft beam profile, a light-sensitive material for scanners exhibiting ultra-high contrast property has been desired.

A large number of photosensitive materials having a photosensitive layer on a support for forming images upon imagewise exposure have been known. Among them, as a system for rendering preservation of environments and image forming means simplified, a technology for forming images by heat development is exemplified.

In recent years, reduction of the amount of waste processing solutions is strongly demanded in the field of photomechanical processes from the standpoint of environmental protection and space savings. To cope with this, techniques are needed in relation to photosensitive heat developable materials for use in photomechanical processes, which can be effectively exposed by a laser scanner or laser image setter and can form clear black images having high resolution and sharpness. Such heat developable photosensitive materials can provide to customers a heat development processing system, without use of solution-type processing chemicals, simpler and free from incurring environmental destruction.

Methods for forming an image by heat development are described, for example, in specifications of U.S. Pat. Nos. 3,152,904 and 3,457,075 and D. Klosterboer, Imaging Processes and Materials, "Thermally Processed Silver Systems", 8th ed., page 2, compiled by J. Sturge, V. Walworth and A. Shepp, Neblette (1969). The photosensitive material used contains a light-insensitive silver source (e.g., organic silver salt) capable of reduction, a photocatalyst (e.g., silver halide) in a catalytic activity amount, and a reducing agent for silver, which are usually dispersed in an organic binder matrix. This photosensitive material is stable at room temperature. However, when it is heated at a high temperature (e.g., 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

Such heat developable photosensitive materials of this type have been known previously, but in most of those photosensitive materials, the photosensitive layer is formed by coating a coating liquid having a solvent of an organic solvent such as toluene, methyl ethyl ketone (MEK), methanol, and the like. Use of such. organic solvents as a solvent not only adversely affects human bodies during manufacturing processes but also is disadvantageous in term of costs due to recycling the solvents and others.

To cope with this, a method has been considered in which a photosensitive layer (hereinafter referred also to as "aqueous photosensitive layer") is formed using a coating liquid of a water solvent not having the above problem. For example, Japanese Unexamined Patent Publication [KOKAI] (hereinafter referred simply to as "JP-A") Showa Nos. 49-52,626 and 53-116,144, and the like set forth an example that gelatin is used as a binder. Also, JP-A-50-151, 138 sets forth an example that a poly vinyl alcohol is used as a binder.

In JP-A-60-61747, an example that a gelatin and a polyvinyl alcohol are used together is described. In WO97/04, 355, an example that a water soluble or water dispersion binder is used in the image forming layer and a water soluble binder such as gelatin, polyvinyl alcohol, cellulose derivatives, or the like is used in a protection layer is described. In addition, as another example other than the above examples, JP-A-58-28,737 sets forth an example of a photosensitive layer that a water-soluble polyvinyl acetal is used as a binder.

Such a binder surely allows to form the photosensitive layer in use of a coating liquid with a water solvent, thereby making such use advantageous in terms of environments and costs.

However, if the polymer such as gelatin, polyvinyl alcohol, water-soluble polyvinyl acetal, and so on is used as the binder, contractions due to dehydration as well as thermal expansions of the binder may occur at the same time and, because different from behavior of the support during thermal expansion, may cause the films to have wrinkles, thereby producing only unsuitable films for color printing in which the film is used in an overlapping manner.

In a meantime, apparatuses and methods for heat developing the heat developable recording material have been generally known, and for example, those are described in U.S. Pat. Nos. 3,629,549, 3,648,019, 3,709,472, and 4,518, 845.

Svendsen's U.S. Pat. Nos. 3,629,549 and 4,518,845, both, disclose developing apparatuses having a drum coaxially attached in and thermally isolated from a heating member.

The sheet made of a film to be developed is engaged with the drum and is driven around the heating member. However, the heat developing apparatus of this type is not suitable for a film having relatively soft thermoplastic polymer binder in the outmost layer. That is, because the surface on a side supporting emulsion comes in contact with the isolation drum and the heating member, the outmost layer of the film may suffer from scratching scars or adhesive marks.

In another type of the heat developing apparatus, a heating drum is incorporated to be statically charged for holding a film during development. With such an apparatus, the outmost layer of the film on a side supporting the emulsion does not contact any structural member, and therefore, no scratching scar described above is made on the surface. However, the electrostatic apparatus used for holding the film on the drum during thermal development is relatively complicated and has a shape not suitable for heat developing a large size film.

Therefore, a technique has been desired to provide a heat developable photosensitive material having good resistance against scratching in use of the aqueous photosensitive layer having advantages in terms of environments and costs, which can be coated with good coating surface quality and may not suffer from beko and side ripples, and a heat developing method thereof.

It is an object of the invention to provide a heat developing method for heat developable image recording material for photomechanical processes, particularly, for scanners or image setters. More specifically, it is an object of the invention to provide a heat developing method for heat developable image recording material with good stability in size before and after heat development in preventing the surfaces of the heat developable image recording material from receiving scars of scratching and adhering during heat development. More particularly, it is yet another object of the invention to provide a heat developable image recording material and a heat developing method in which images can be obtained without processing unevenness but with stable heat developing processing property which provides good conveyance and prevents the surfaces from receiving scratching scars.

SUMMARY OF THE INVENTION

The above objects are accomplished by means described below.

This invention is a heat developing method conveying, to make a heating processing on a heater surface, a heat developable image recording material in which an image forming layer and a protection layer are formed using a polymer latex as a binder on one side of a support prepared by subjecting a polyester biaxially drawn and crystallized with orientation to a thermal relaxation processing at a temperature equal to or higher than 130° C. and equal to or lower than 200° C. at a conveyance tension of 7 kg/cm$^2$ or lower and in which a back layer is formed using a polymer latex as a binder on the other side of the support, the method comprising the steps of: preparing at least two heaters for providing heating processing at a prescribed temperature to the heat developable image recording material disposed securely in line in a conveyance direction of the heat developable image recording material; conveying the heat developable image recording material with a conveying means by sliding the heat developable image recording material on surfaces of the heaters; and thermally processing the heat developable image recording material by pressing at least a part of the heat developable image recording material during conveyance with a pressing means against the surfaces of the heaters.

As suitable embodiments of the heat developing method of the invention, exemplified are: the pressing means is a plurality of pressing rollers disposed on the surface of the heater; the pressing roller is coupled to a rotary driving means and serves as the conveying means for sliding the heat developable image recording material on the surface of the heater; the pressing rollers rotate at the same predetermined circumferential velocity; the respective heaters are plate shaped heaters and arranged in a plane; the respective heaters have a fluororesin coated contact surface in contact with the heat developable image recording material or have a processing sheet made of a fluororesin and disposed at the heaters; a heat developing method processing, with a heating developing apparatus having a preliminary heating section and a heat developing processing section, a heat developable image recording material having on a support at least one image forming layer and at least one protection layer formed on the image forming layer, the method comprising, to make a developing processing, the steps of conveying the heat developable image recording material by opposing rollers in the preliminary heating section, contacting a surface on a side having the image forming layer to a drive roller in the heat developing processing section, and conveying the heat developable image recording material by sliding the back surface located oppositely to the side having the image forming layer in contact with a smooth surface, wherein a linear velocity (line speed) rate of the preliminary heating section to the heat developing section is equal to or lower than 99.9% and equal to or higher than 95.0%; the developing processing is made with the linear velocity of 10 to 40 mm/sec; the heat developing apparatus has a rubber roller, in contact with .he surface on the side having the image forming layer, at least whose surface is made of a rubber having rubber hardness of 50 degrees or below; the roller at least has a surface made of a silicone rubber; the smooth surface of the heat developing processing section of the heat developing apparatus in contact with the back surface located oppositely to the side having the image forming layer is formed of a non-woven fabric made of aromatic polyamide or polytetrafluoroethylene (Teflon); and a clearance between the smooth surface in contact with the surface located oppositely to the side having the image forming layer during conveyance of the heat developable image recording material and the surface of the drive roller in contact with the surface located on the side having the image forming layer during conveyance of the heat developable image recording material is of 0 to 2 mm.

This invention is also to provide a heat developable image recording material processed by the above heat developing method having, at a temperature when heat development is processed, a ratio of a friction coefficient between the surface on the side having the image forming layer and the roller surface of the heat developing processing section to a friction coefficient between the back surface located oppositely to the side having the image forming layer and the smooth surface of the heat developing processing section is set to 1.5 or higher.

As suitable embodiments of the heat developable image recording material of the invention, exemplified are: the friction coefficient between the back surface located oppositely to the side having the image forming layer and the smooth surface of the heat developing processing section is of 1.0 or lower at a temperature when heat development is processed; a polymer latex is used for binders in the image forming layer and the protection layer; at least one conductive layer having a surface specific resistance of $1\times10^{12}$ Ω or lower under a condition of 25° C., 20% RH on the side oppositely to the image forming layer; and a back layer on the side opposite to the side having the image forming layer, wherein a polymer latex is used for binder in the back layer.

DETAILED DESCRIPTION OF THE INVENTION

Figure 1:
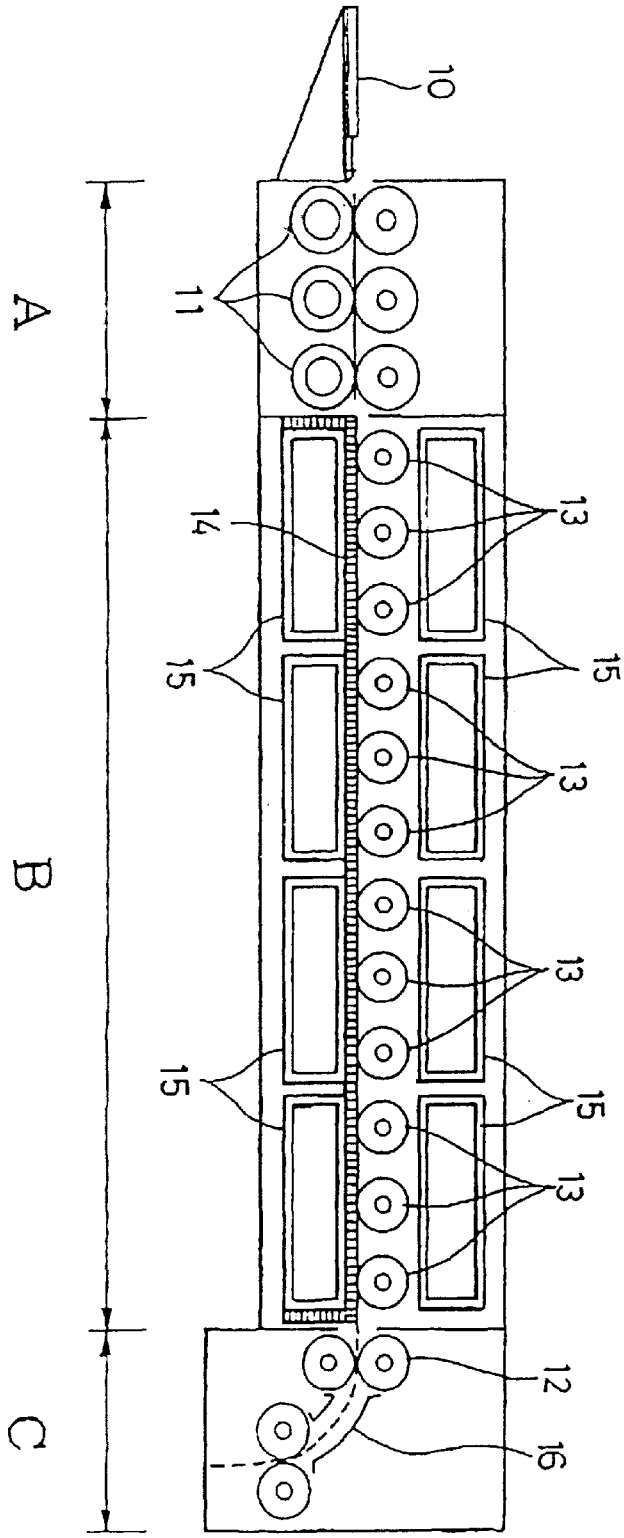
FIG. 1 is a side view showing a structure of a heat developing apparatus used in his invention.

The heat developable image recording material according to the invention has an image forming layer containing an organic silver salt, preferably, a reducing agent and a photosensitive silver halide on a support, and has at least one protection layer on the image forming layer. The heat developable image recording material of the invention has at least one layer on a side opposite to the image forming layer with respect to the support, and a polymer latex or latexes are used for benders of the image forming layer, the protect on layer, and the back layer. Where the polymer latex is used for those layers, an aqueous coating car be made using a solvent (dispersion medium) having water as a main component, thereby providing advantages in terms of environments and costs, and the heat developable image recording material free from occurrence of wrinkles during heat development. As a support of the heat developable image recording material, used is a polyester biaxially drawn and crystallized with orientation, which is subject to a thermal relaxation processing at a temperature equal to or higher than 130° C. and equal to or lower than 200° C. at a conveyance tension of 7 kg/cm$^2$ or lower and therefore, size shifts due to heat development are reduced.

In the heat developing method, the heat development is implemented by using such a heat developable image recording material and using simultaneously the conveying means for sliding the heat developable image recording material on the surface of the heaters and the pressing means for pressing at least a part of the heat developable image recording material during conveyance against the surfaces of the heaters. The heaters in this situation are securely arranged adjacently to each other in two or more (generally, 2 to 6 pieces) in the conveyance direction of the heat developable image recording material and are preferably plate shaped heaters and arranged in a plane. The pressing means is preferably a plurality of pressing rollers disposed on the surface of the heater (two to five per one heater), and those plural rollers are preferably coupled to a rotary driving means, and the pressing rollers preferably rotate at the same predetermined circumferential velocity (generally, 5 to 40 mm/sec). The pressing rollers preferably serve as the conveying means for the heat developable image recording material. As such a heat developing apparatus for implementing the heat developing method, a structure shown in FIG. 1 exists and will be described below.

According to implementation of the heat developing method of the invention, the method prevents beko, side ripples, and density unevenness from occurring and brings no occurrence of scars. To the contrary, if the polymer latex is not used in the protection layer on the image forming layer side of the heat developable image recording material, beko and side ripples ray occur. If the polymer latex is not used in the protection layer of the back layer, wrinkles and density unevenness may occur. On the other hand, if a heat developing method, as different from the above method, such as a drum development or the like, is used, side ripples may occur, thereby rendering scar occurrences serious. To eliminate occurrences of scars, it is preferable to design that each heater has a fluororesin coated contact surface (generally, back surface) in contact with the heat developable image recording material or has a fluororesin sheet disposed at the heater. The thickness of the coating layer or the sheet in this case is preferably 0.5 to 1.0 mm.

In the heat developing apparatus as shown in FIG. 1, the heat developable image recording material is conveyed by opposing rollers in the preliminary heating section, and the heat developable image recording material is conveyed by sliding the material in contacting a surface on the side having the image forming layer of the heat developable image recording material to a drive roller in the heat developing processing section. In this situation, where the developing processing is made with a condition that a linear velocity rate of the preliminary heating section to the heat developing section is equal to or lower than 99.9% and equal to or higher than 95.0%, the method prevents scratching scars and density unevenness from occurring and has stable heat developing processing property.

To obtain such advantages, it is preferable to so restrict that, at a temperature when heat development is processed, a ratio of a friction coefficient between the surface on the side having the image forming layer and the roller surface to a friction coefficient between the back surface and the smooth surface is set to 1.5 or higher.

To the contrary, if the linear velocity rate becomes 95.0% or less, the conveyance property may become worse since scratching scars and paper jamming may occur, and the density unevenness may tend to occur. On the other hand, if the rate exceeds 99.9%, the conveyance property also becomes worse.

The polymer latex used for the binders of the invention is a water-insoluble hydrophobic polymer as fine particles dispersed in a water-soluble dispersion medium. With respect to the dispersion state, the polymer may be emulsified in the dispersion medium, emulsion-polymerized or micell dispersed or the polymer may have a partially hydrophilic structure in the polymer molecule so that the molecular chain itself is dispersed in the molecule. The polymer latex in the present invention is described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keshi Kasarara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably on the order of from 5 to 1,000 nm. The particle size distribution of the dispersed particles is not particularly limited, and the dispersed particles may have a broad particle size distribution or a mono-disperse particle size distribution.

As the polymer latex used for the present invention, a so-called core and shell type latex may be used other than the normal polymer latex having a uniform structure. In this case, it is preferred in some cases that the core and the shell have different glass transition temperatures.

The polymer latex used as the binder in the present invention has a glass transition temperature (Tg) of which preferred range may be different among those for the protection layer, the back layer and the image forming layer. In the protection layer and the back layer (especially, the outmost layer), the glass transition temperature is 25° C. or higher, preferably 25° C. to 100° C. because brought into contact with various instruments from a view to film rigidity and prevention of malfunctions caused by adherence. In the image forming layer, the glass transition temperature is preferably from −30° C. to 40° C., to promote diffusions of the photographically useful materials during the heat development and to obtain good photographic nature such as high Dmax and low fog. The gel fraction in this case is sought according to the following formula where a film sample made at the dry temperature of 70° C. using a polymer latex is dipped in a tetrahydrofuran (THF) at 25° C. for twenty-four hours and where unsolved materials are quantitatively determined.

Gel fraction (wt %)={weight of unsolved materials (g)/weight of film using the polymer latex (g)}×100.

The polymer latex for use n the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer and it is an organic compound (usually an organic solvent) capable of reducing the minimum film-forming temperature of the polymer latex. This organic compound is described in Souichi Muroi, Gosei Latex no Kagaku (Chemistry of Synthetic Latex), Kobunshi Kanko Kai (1970), as described above.

The polymer species of the polymer latex for use in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a weight average molecular weight of from 5,000 to 1,000,000, more preferably on the order of from 10,000 to 100,000. If the molecular weight is too small, the image-forming layer is deficient in the mechanical strength, whereas if it is excessively large, the film forming property is disadvantageously poor.

Specific examples of the polymer latex used as a binder in the heat developable image recording material of the present invention include methyl methacrylate/ethyl acrylate/nethacrylic acid copolymer, methyl methacrylate/2-ethylhexyl acrylate/hydroxyethyl methacrylate/styrene/acrylic acid copolymer, methyl methacrylate/butyl acrylate copolymer, styrene/butadiene/acrylic acid copolymer, styrene/butadiene/divinylbenzene/nethacrylic acid copolymer, methyl methacrylate/vinyl chloride/acrylic acid copolymer, vinylidene chloride/ethyl acrylate/acrylonitrile/methacrylic acid copolymer, and the like. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 820, 857, 857x2 (all produced by Nippon Zeon Co., Ltd) VONCORT R3340, R3360, R3370, 4280, 2830, 2210 (all produced by Dainippon Ink & Chemical, Inc) Julimer ET-410, 530, SEK101-SEK301, FC30, FC35 (Nihon Junyaku Co., Ltd.), Polysol F410, AM200, AP50 (Showa Kobunshi Co. Ltd.), etc.; polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.), VONDIC 132 ONS (Dai-Nippon Ink & Chemical, Inc.); rubber-based resins such as LACSTAR 7310K, 3307B, 4700H, 7132C, LQ-618-1 (all produced by Dai-Nippon Ink & Chemicals, Inc.), Nipol Lx416, 410, 430, 435, 2507 (all produced by Nippon Zeon Co., Ltd.); vinyl chloride resins such as Nipol G351, G576 (both produced by Nippon Zeon Co., Ltd.); vinylidene chloride resins such as L502, L513 (both produced by Asahi Chemical Industry Co., Ltd.), ARON D7020, D504, D5071 (all produced by Mitsui Petrochemical Industries, Ltd.); and olefin resins such as CHEMIPEARL S120 and SA100 (both produced by Mitsui Petrochemical Industries, Ltd.) and the like. These polymers may be used individually or if desired, as a blend of two or more thereof.

As binders for the protection layer of the invention, among these polymer latexes, preferably used are those of acryl based, styrene based, acryl/styrene based, vinyl chloride based, and vinylidene chloride based and, core specifically, preferably used are acrylic based resins, such as VONCORT R3370, 4280, Nipol Lx857, methyl methacrylate/2-ethylhexyl acrylate/hydroxyethyl methacrylate/styrene/acrylic acid copolymer, methyl methacrylate/butyl acrylate copolymer, vinyl chloride based Nipol G576, and vinylidene chloride based ARON D7020. More preferably, combinations of polymer latexes having different I/O values in which inorganic value is divided by organic value based on an organic conception diagram as described in Japanese Patent Appln. No. 11-6,872 can be used.

As for binders for image forming layer, styrene/butadiene based polymer latexes can be preferably used, and more specifically, rubber based LACSTAR3307R, Nipol Lx430, 435 are preferably used.

As for binders for back layer, acryl based, olefin based, and vinylidene chloride based polymer latexes can be preferably used, and more specifically, preferable are acryl based Julimer ET-410, CEBIAN A-4635, Polysol F410, etc. olefin resin based CHEMIPEARL S120, vinylidene chloride based L502, ARON D7020, and the like.

Hydrophllic polymers such as polyvinyl alcohol, methyl cellulose, hydroxypropyl cellulose, carboxymethyl cellulose and hydroxypropylmzethyl cellulose may be added according to necessity to the binders of the invention in a range of 20 wt % of the whole binders or less. The adding amount of those hydrophilic polymers is preferably 10 wt % the whole binders of the protection layer and the image forming layer or less.

A photograph-structuring layer of the invention is preferably prepared in drying an aqueous coating liquid after coating. It is to be noted What the word "aqueous" herein means the solvent (dispersion medium) of the coating liquid contains water of 60 wt % or higher. Components other than water of the coating solution may be a water-miscible organic solvent such as methyl alcohol, ethyl alcohol, isopropyl alcohol, methyl cellulose, ethyl cellulose, dimethylformamide, ethyl acetate, diacetone alcohol, fulfill alcohol, benzyl alcohol, diethylene glycol monoethylether, oxyethyl phenyl ether, and the like.

The whole binder amount for protection layer of the invention is preferably, 0.2 to 10.0 g/m$^2$, more preferably, 0.5 to 6.0 g/m$^2$.

The whole binder amount for image forming layer of the invention is preferably, 0.2 to 30 g/m$^2$, more preferably, 1.0 on 15 g/m$^2$.

The whole binder amount for back layer of the invention is preferably, 0.01 to 10.0 g/m$^2$, more preferably, 0.05 to 5.0 g/m$^2$.

Crosslinking agents for crosslinks, surfactants for improving coating property, and the like as described in JP-A2000-19678 may be added to each layer.

Two or more layers of those layer may be formed together. Where the image forming layer is made of two or more layers, it is preferable to use polymer latex as binders of the whole layers. Although the protection layer is a layer formed over the image forming layer, and two or more of layers may exist, it is preferable to use a polymer latex for at least one layer, particularly, the outmost layer of the protection layer. Although the back layer is a layer formed above the undercoating layer of the back surface of the support, and two or more of layers may exist, it is preferable to use a polymer latex for at least one layer, particularly, the outmost layer of the back layer.

For the heat developable image recording material of the present invention, various kinds of support can be used.

Typical supports comprise polyester such as polyethylene terephthalate, and polyethylene naphthalate, cellulose nitrate, cellulose ester, polyvinyl acetal, syndiotactic polystyrene, polycarbonate, paper support whose double sides are coated with polyethylene or the like. Among these, biaxially stretched polyester, especially polyethylene terephthalate (PET), is preferred in view of strength, dimensional stability, chemical resistance and the like. The support preferably has a thickness of 90 to 180 $\mu$m as a base thickness excluding the undercoat layer.

Preferably used as the support of the heat developable image recording material of the present invention is a polyester film, in particular polyethylene terephthalate film, subjected to a heat treatment in a temperature range of 130 to 185° C. in order to relax the internal distortion formed in the film during the biaxial stretching so that thermal shrinkage distortion occurring during the heat development should be eliminated. Such a thermal relaxation treatment may be performed at a constant temperature within the above temperature range, or it may be performed with raising the temperature.

The heat treatment of the support may be performed for the support in the form of a roll, or it may be performed for the support that is conveyed as a web. When it is performed for a support that is conveyed as a web, it is preferred that the conveying tension should be not more than 7 kg/cm$^2$, in particular, not more than 4.2 kg/cm$^2$. The lower limit of the conveying tension is, while not particularly limited, 0.5 kg/m$^2$ or so.

This heat treatment is preferably performed after a treatment for improving adhesion of the image forming layer and the back layer to the support, for example application of the undercoat layer and the like.

The thermal shrinkage of the support upon heating at 120° C. for 30 seconds is preferably −0.03% to +0.01% for the machine direction (MD), and 0 to 0.04% for the transverse direction (TD).

The support may be applied with an undercoat layer containing SBR, vinylidene chloride, polyester, gelatin or he like as a binder, as required. The undercoat layer may be composed of multiple layers, and may be provided on a single side or double sides of the support. At least one of the undercoat layers may be an electroconductive layer. The undercoat layer generally has a thickness of 0.01 to 5 $\mu$m, more preferably 0.05 to 1 $\mu$m (for one layer). When it is an electroconductive layer, it preferably has a thickness of 0.01 to 1 $\mu$m, more preferably 0.03 to 0.8 $\mu$m.

The back layer or the undercoat layer adjacent to the support of the heat developable image recording material of the invention, preferably contain metal oxides in order to reduce dust adhesion, and it is preferred that at least one of the back layer and the undercoat layer (those provided on the double sides of the support) should be an electroconductive layer. It is to be noted that the electroconductive layer is preferably not the back layer of the outmost layer.

As the metal oxide used for this, those disclosed in JP-A-61-20033 and JP-A-56-82504 are particularly preferred.

According to the present invention, the amount of the electroconductive metal oxide is preferably 0.05 to 20 g, particularly preferably 0.1 to 10 g per 1 m$^2$ of the image recording material. Surface resistivity of the metal oxide-containing layer is not more than $10^{12}$ Ω, preferably not more than $10^{11}$ Ω under an atmosphere of 25° C. and 25% RH. Such surface resistivity affords good antistatic property. The lower limit of the surface resistivity is not particularly limited, but it is generally around $10^7$ Ω.

According to the present invention, further improved antistatic property can be obtained by using a fluorine containing surfactant in addition to the aforementioned metal oxide.

The preferred fluorine-containing surfactants for use in the invention are surfactants which have a fluoroalkyl, fluoroalkenyl or fluoroaryl group which has at least 4 carbon atoms (usually 15 or less), and which have, as ionic groups, anionic groups (for example, sulfonic acid or salts thereof, sulfuric acid or salts thereof, carboxylic acid or salts thereof, phosphoric acid or salts thereof), cationic groups (for example, amine salts, ammonium salts, aromatic amine salts, sulfonium salts, phosphonium salts), betaine groups (for example, carboxyamine salts, carboxyammonium salts, sulfoamine salts, sulfoammonium salts, phosphoammonium salts), or non-ionic groups (substituted or unsubstituted poly(oxyalkylene) groups, polyglyceryl groups or sorbitane residual groups).

Such fluorine-containing surfactants have been disclosed, for example, in JP-A-49-10722, British Patent 1,330,356, U.S. Pat. Nos. 4,335,201 and 4,347,308, British Patent 1,417,915, JP-A-55-149938, JP-A-58-196544 and British Patent No. 1,439,402. Specific examples of these materials are indicated below.

F-1 $C_8F_{17}SO_3K$

F-2

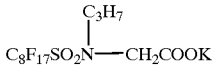

F-3

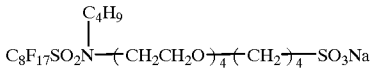

F-4

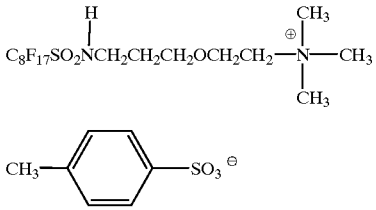

F-5 $C_8F_{17}SO_3Li$

No limitation is imposed upon the layer to which the fluorine-containing surfactant is added provided that it is included in at least one layer of the image recording material, and it can be included, for example, in the surface protecting layer, emulsion layer, intermediate layer, undercoat layer or back layer. It is, however, preferably added to the surface protective layer, and while it may be added to one of the protective layers on the image-forming layer side and the back layer side, it is further preferably added to at least the protective layer on the image-forming layer side.

When the surface protective layer is composed of two or more layers, the fluorine-containing surfactant can be added to any of these layers, or it may be used in the form of an overcoat over the surface protective layer.

The amount of fluorine-containing surfactant used in this invention may be from 0.0001 to 1 g, preferably from 0.0002 to 0.25 g, particularly desirably from 0.0003 to 0.1 g, per 1 m$^2$ of the image recording material.

Furthermore, two or more of the fluorine-containing surfactants can be mixed together.

Beck smoothness in the present invention can be easily determined by Japanese Industrial Standard (JIS) P8119, "Test Method for Smoothness of Paper and Paperboard by Beck Test Device" and TAPPI Standard Method T479.

Beck smoothness of at least one, or preferably both of the outermost layers of the image-forming layer side and the opposite side of the heat-developable image-recording material according to the present invention is 2000 seconds or less, preferably from 10 seconds to 2000 seconds.

Beck smoothness of the outermost layers of the image-forming layer side and the opposite side of the heat-developable image-recording material according to the present invention can be controlled by changing an average particle diameter and an addition amount of microparticles called matting agent incorporated into the outermost layers on the both sides. The matting agent is preferably contained in the outermost layer of the protective layer remotest from the support for the side of the image-forming layer, and in a layer of the back layer which is not the outermost layer for the opposite side.

The average particle diameter of the matting agent in the present invention is preferably in the range of from 1 to 10 $\mu$m.

The amount of the matting agent added in the present invention is preferably in the range of from 5 to 400 mg/m$^2$, particularly in the range of from 10 to 200 mg/m$^2$.

The matting agent used in the present invention may be any solid particles so long as they do not adversely affect various photographic properties. Inorganic matting agents include silicon dioxide, titanium and aluminum oxides, zinc and calcium carbonates, barium and calcium sulfates, calcium and aluminum silicates and the like, and organic matting agents include cellulose esters, organic polymer matting agents such as those of polymethyl methacrylate, polystyrene or polydivinylbenzene, copolymers thereof and the like.

In the present invention, it is preferred to use a porous matting agent described in JP-A-3-109542, page 2, lower left column, line 8 to page 3, upper right column, line 4, a matting agent in which the surface thereof has beer modified with an alkali described in JP-A-4-127142, page 3, upper right column, line 7 to page 5, lower right column, line 4, or a matting agent of an organic polymer described in JP-A-6-118542, Paragraph Nos. [0005] to [0026].

Further, two or more kinds of these matting agents may be used in combination. For example, a combination of an inorganic matting agent and an organic matting agent, a combination of a porous matting agent and a non-porous matting agent, a combination of indefinite shape matting agent and a globular matting agent, a combination of matting agents having different average particle diameters (for example, a combination of a matting agent having an average particle diameter of 1.5 $\mu$m or more and a matting agent having an average particle diameter of 1 $\mu$m or less as described in JP-A-6-118542) can be used.

In this invention, a ratio of a friction coefficient ($\mu$e) between the surface of the outmost layer on the side having the image forming layer of the heat developable image recording material and the roller surface of the heat developing processing apparatus to a friction coefficient ($\mu$b) between the surface of the back surface outmost layer and the smooth surface of the heat developing processing apparatus at the heat developing processing temperature is sought according to the following formula where kinematic friction coefficient at a constant speed and a constant load at the heat developing processing temperature is measured on the surface of the image recording material in contact with the roller or the smooth surface member of the heat developing apparatus.

Ratio of frictional coefficient=kinematic friction coefficient ($\mu$e) between the roller member of the heat developing processing apparatus and the surface having the image forming layer/kinematic friction coefficient ($\mu$b) between the surface of the back surface outmost layer and the smooth surface of the heat developing processing apparatus.

This value is preferably 1.5 or higher, and there is no upper limitation to the value but about 30. The $\mu$b is preferably 1.0 or below, and more preferably, 0.8 to 0.05.

The heat developing processing temperature (except the heating temperature for preliminary heating) is generally constant, but the heat developing processing temperature where the temperature is changed is in a range of 80° C. to 150° C., more preferably 100° C. to 130° C., and the ratio of the friction coefficients in such a case is calculated from ìe, ìb at the maximum temperature.

In this invention, the sliding property at the heat developing processing temperature between the member of the heat developing processing apparatus and the surface having the image forming layer and/or the outmost layer on the opposite side to the image forming layer can be adjusted by containing the lubricant in the outmost layer and changing the adding amount.

No particular limitation is imposed upon the lubricant used in the present invention, and any compound which, when present at the surface of an object, reduces the friction coefficient of the surface relative to that when the compound is absent can be used for this purpose.

Typical examples of the lubricant which can be used in the present invention include the silicone based lubricants disclosed in U.S. Pat. No. 3,042,522, British Patent No. 955, 061, U.S. Pat. Nos. 3,080,317, 4,004,927, 4,047,958 and 3,489,567, British Patent No. 1,143,118 and the like, the higher fatty acid based, alcohol based and acid amide based lubricants disclosed in U.S. Pat. Nos. 2,454,043, 2,732,305, 2,976,148 and 3,206,311, German Patent Nos. 1,284,295, 1,284,294 and the like, the metal soaps disclosed in British Patent No. 1,263,722, U.S. Pat. No. 3,933,516 and the like, the ester based and ether based lubricants disclosed in U.S. Pat. Nos. 2,588,765, 3,121,060, British Patent No. 1,198, 387, the taurine based lubricants disclosed in U.S. Pat. Nos. 3,502,473 and 3,042,222 and the like.

Specific examples of the lubricant preferably used include, CELLOSOL 524 (main ingredient is carnauba wax), POLYLON A, 393, H-481 (main ingredient is polyethylene wax), HIMICRON G-110 (main ingredient is ethylene bis-stearic acid amide), HIMICRON G-270 (main ingredient is stearic acid amide) (all from Chukyo Oil & Fat Co., Ltd.).

Furthermore, compounds represented by the following Formula (W) can be used preferably.

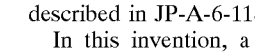

$$R—O—SO_3^-M \qquad \text{Formula (W)}$$

In Formula (W), R represents aliphatic groups having 10 or higher carbon number; M represents cation.

R represents straight chain, branched, or ring alkyl group, alkenyl group, and alkynyl group, substituted or non-substituted having 10 to 30 carbon number.

When R represents a substituent, examples of the substituent include a halogen atom (e.g., fluorine, chlorine, bromide, iodine), an aryl group, a heterocyclic group, a quaternized nitrogen-containing heterocyclic group (e.g., pyridinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethyleneoxy group or propyleneoxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, an N-substituted nitrogen containing heterocyclic group, an acylamino group, a sulfonamide group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group or a salt thereof, an (alkyl, aryl or heterocyclic)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure.

These substituents each may further be substituted by any of the above-described substituents.

The substituents that R may have are preferably,a hydroxy group, an alkoxy group, an aryloxy group, an acyloxy group, a halogen atom, a cyano group, a nitro group, and the like.

M indicates monovalent cation, and it is preferably an alkali metal cation such as $Li^+$, $Na^+$, $K^+$, and the like.

Hereinafter, specific examples of compounds represented by Formula (W) are shown, but this invention is not limited to the following compounds.

$C_{16}H_{33}—O—SO_3^{\ominus}Na^{\oplus}$ W-1

$C_{18}H_{37}—O—SO_3^{\ominus}Na^{\oplus}$ W-2

$C_{20}H_{41}—O—SO_3^{\ominus}Na^{\oplus}$ W-8

W-9

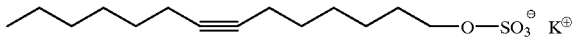

The compounds of Formula (W) used in this invention are usable in solving with water or proper organic solvent, for example, alcohol group (methanol, ethanol, propanol, fluorination alcohol), ketone group (acetone, methyl ethyl ketone), dimethylformamide, dimethylsulfoxyide methyl cellulose, and the like.

The compounds of Formula (W) can be used solely as well as two or more kinds together. The addition layer is not particularly limited, but it is preferable to place the layer as the outmost layer of the back surface. The adding amount is preferably 0.005 to 1.0 g/$m^2$ as indication of coating amount per $m^2$ of recording material (total of double sides). In the layer containing the compounds of Formula (W), a part of 75 wt % or higher on the total binders is preferably formed of a water dispersion type polymer latex. As a polymer latex, described above can be used.

The used amount of the lubricant is 0.1 to 50 wt % of the binder amount in the addition layer, preferably 0.5 to 30 wt %.

Undercoat layers containing a vinylidene chloride copolymer are preferably provided on double sides of the support of the present invention. The vinylidene chloride copolymer for this contains 70% by weight or more of vinylidene chloride monomer repeating units (also referred to as "vinylidene chloride monomers" hereinafter). When the vinylidene chloride monomer content is less than 70% by weight, sufficient moisture barrier property cannot be obtained, and hence the dimensional change over time after the heat development becomes large. The vinylidene chloride copolymer preferably contains carboxyl group-containing vinyl monomer repeating units (also referred to as "carboxyl group-containing vinyl monomers") as repeat-

W-3

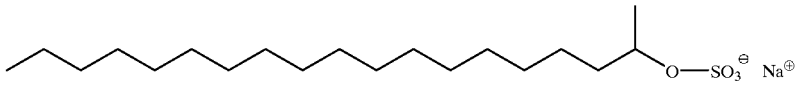

W-4

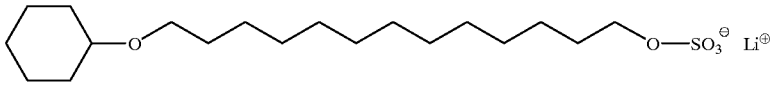

W-5

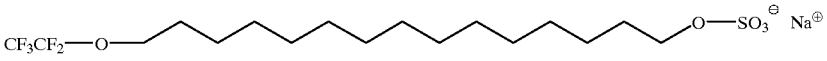

W-6

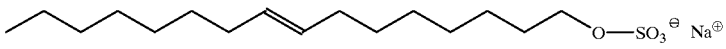

W-7

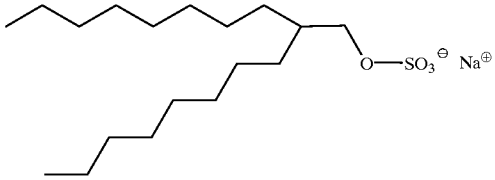

ing units other than the vinylidene chloride monomers. Such structural repeating units are contained because the vinyl chloride monomers alone afford crystallization of the polymer, which makes it difficult to form a uniform film when the moisture barrier layer is coated, and the carboxyl group-containing vinyl monomers are indispensable for stabilization of the polymer.

The vinylidene chloride copolymer of the present invention is a copolymer preferably containing 70–99.9% by weight, more preferably 85–99% by weight of vinylidene chloride monomers and preferably 0.1–5% by weight, more preferably 0.2–3% by weight of carboxyl group-containing vinyl monomers.

The carboxyl group-containing vinyl monomer used for the vinylidene chloride copolymer of the present invention is a vinyl monomer having one or more carboxyl groups in a molecule, and specific examples thereof include, for example, acrylic acid, methacrylic acid, itaconic acid, citraconic acid and the like.

The vinylidene chloride copolymer of the present invention may contain repeating units of monomers other than the vinylidene chloride monomer and the carboxyl group-containing monomer, which are copolymerizable with these monomers.

Examples of such monomers include, for example, acrylonitrile, methacrylonitrile, methyl acrylate, ethyl acrylate, methyl methacrylate, glycidyl methacrylate, 2-hydroxyethyl methacrylate, vinyl acetate, acrylamide, styrene, and the like.

These monomers can be used individually, or in any combination of two or more of them.

The molecular weight of the vinylidene chloride copolymer of the present invention is preferably 45000 or less, more preferably 10000 to 45000 in terms of weight average molecular weight. When the molecular weight becomes too large, adherence between the vinylidene chloride copolymer layer and the support layer of polyester or the like is degraded.

The vinylidene chloride copolymer of the present invention may be used by dissolving it in an organic solvent, or as an aqueous dispersion of latex. However, the aqueous dispersion of latex is preferred.

In the latter case, the latex may have polymer particles in a uniform structure, or in a so-called core/shell structure comprising a core and a shell with different compositions.

The particle size or the like of the polymer particles in the latex may be similar to those used for the binder of the image forming layer or the protection layer. The sequence of the monomeric units of the vinylidene chloride copolymer is not particularly limited, and it may show periodicity or randomness, or may be composed of blocks.

The following can be mentioned as specific examples of the vinylidene chloride copolymer of the present invention. The parenthesized numerals indicate weight ratios. The average molecular weights represent weight average molecular weights.

V-1: latex of vinylidene chloride/methyl acrylate/acrylic acid (90:9:1, average molecular weight of 42000);

V-2: latex of vinylidene chloride/methyl acrylate/methyl methacrylate/acrylonitrile/methacrylic acid (87:4:4:4:1, average molecular weight of 40000);

V-3: latex of vinylidene chloride/methyl methacrylate/glycidyl rethacrylate/rethacrylic acid (90:6:2:2, average molecular weight of 38000);

V-4: latex of vinylidene chloride/ethyl methacrylate/2-hydroxyethyl methacrylate/acrylic acid (90:8:1.5:0.5, average molecular weight of 44000);

V-5: core shell type latex (90% by weight of core and 10% by weight of shell);

Core: vinylidene chloride/methyl acrylate/methyl methacrylate/acrylonitrile/acrylic acid (93:3:3:0.9:0.1);

Shell: vinylidene chloride/methyl acrylate/methyl methacrylate/acrylonitrile/acrylic acid (88:3:3:3:3), (average molecular weight of 38000).

V-6: core shell type latex (70% by weight of core and 30% by weight of shell)

Core: vinylidene chloride/methyl acrylate/methyl methacrylate/acrylonitrile/methacrylic acid (92.5:3:3:1:0.5);

Shell: vinylidene chloride/methyl acrylate/methyl methacrylate/acrylonitrile/methacrylic acid (90:3:3:1:3), (average molecular weight of 20000).

The vinylidene chloride copolymers may be used individually, or in any combination of two or more of other.

The vinylidene chloride copolymer of the present invention is used in such an amount that the undercoat layer containing the vinylidene chloride copolymer should have a total thickness for one side of 0.3 $\mu$m or more, preferably 0.3 to 4 $\mu$m.

The vinylidene chloride copolymer layer serving as the undercoat layer is preferably provided as the first undercoat layer that is directly coated on the support. While one undercoat layer is usually provided for each side, two or more layers ray be provided as the case may be. When a multiple-layer structure composed of two or more layers is used, the vinylidene chloride copolymer amount range defined by the present invention may be satisfied by the total amount of the vinylidene chloride copolymers in such layers.

Because the vinylidene chloride copolymer layer usually is made of a monolayer structure as mentioned above, the thickness is preferably 0.3 to 4 $\mu$m, more preferably 0.6 to 3 $\mu$m, particularly preferably 1.0 to 2 $\mu$m in order to obtain a good applied surface condition.

This layer may contain, other than the vinylidene chloride copolymer, a crosslinking agent, a matting agent and the like.

The photosensitive silver halide used in this invention can be any of silver chloride, silver chlorobromide, and silver iodobromide. The profile of the halogen composition in the particle can be uniform, changed stepwise in the halogen composition, or change continuously.

The method of forming photosensitive silver halide in the present invention is well known in the art and, for example, the methods described in Research Disclosure, No. 17029 (June, 1978) and U.S. Pat. No. 3,700,458 may be used. Specifically, a method comprising the step of converting a part of silver in the produced organic silver salt to photosensitive silver halide by adding a halogen-containing compound to the organic silver salt, or a method comprising the steps of adding a silver-supplying compound and a halogen-supplying compound to gelatin or other polymer solution to thereby prepare photosensitive silver halide and mixing the silver halide with an organic silver salt may be used for the present invention. The photosensitive silver halide particle preferably has a small particle size so as to prevent high white turbidity after the formation of an image. Specifically, the particle size is preferably 0.20 $\mu$m, or less, more preferably from 0.01 to 0.15 $\mu$m, still more preferably from 0.02 to 0.12 $\mu$m. The term "particle size" as used herein means the length of an ridge of the silver halide particle in the case where the silver halide particle is a regular crystal such as cubic or octahedral particle; the diameter of a circle image having the same area as the projected area of the main surface plane in the case where the silver halide particle is a tabular silver halide particle; or the diameter of a sphere having the same volume as the silver halide particle in the case of other irregular crystals such as spherical or bar particle.

Examples of the shape of the silver halide particle include cubic form, octahedral form, tabular form, spherical form, stick form and bebble form, and among these, cubic particle and tabular particle are preferred in the present invention. When a tabular silver halide particle is used, the average aspect ratio is preferably from 100:1 to 2:1, more preferably from 50:1 to 3:1. A silver halide particle having rounded corners is also preferably used. The face index (Miller indices) of the outer surface plane of a photosensitive silver halide particle is not particularly limited; however, it is preferred that [100] faces capable of giving a high spectral sensitization efficiency upon adsorption of the spectral sensitizing dye occupy a high ratio. The ratio is preferably 50% or more, more preferably 65% or more, still more Preferably 80% or more. The ratio of [100] faces according to the Miller indices can be determined by the method described in T. Tani, J. Imaging Sci., 29, 165 (1985) using the adsorption dependency of [1111] face and [100] face upon adsorption of the sensitizing dye.

The photosensitive silver halide particle for use in the present invention contains a metal or metal complex of Group VIII or VIII ($7^{th}$ to $10^{th}$ Groups) in the Periodic Table. The center metals of the metal or metal complex of Group VII or VIII of the Periodic Table are preferably rhodium, rhenium, ruthenium, osnium or iridium. One kind of metal complex may be used or two or more kinds of complexes of the same metal or different metals may also be used in combination. The metal complex content is preferably from $1\times10^{-9}$ to $1\times10^{-2}$ mol, more preferably from $1\times10^{-8}$ to $1\times10^{-4}$ mol, per mol of silver. With respect to the specific structure of the metal complex, the metal complexes having the structures described in JP-A-7-225,449 may be used.

As the rhodium compound for use in the present invention, a water-soluble rhodium compound may be used. Examples thereof include a rhodium(III) halogenide compounds and rhodium complex salts having a halogen, an amine or an oxalate as a ligand, such as hexachlororhodium (III) complex salt, pentachloroaquorhodium(III) complex salt, tetrachlorodiacuorhodium(III) complex salt, hexabromorhodium(III) complex salt, hexaamminerhodium (III) complex salt and trioxalatorhodium(III) complex salt. The rhodium compound is used after dissolving it in water or an appropriate solvent and a method commonly used for stabilizing the rhodium compound solution, that is, a method comprising adding an aqueous solution of hydrogen halogenide (e.g., hydrochloric acid, bromic acid, fluoric acid) or halogenated alkali (e.g., KCl, NaCl, KBr, NaBr) may he used. In place of using a water-soluble rhodium, separate silver halide particles previously doped with rhodium may be added and dissolved at the time of preparation of silver halide.

The amount of the rhodium compound added is preferably from $1\times10^{-8}$ to $5\times10^{-6}$ mol, more preferably from $5\times10^{-8}$ to $1\times10^{-6}$ mol, per mol of silver halide.

The rhodium compound may be appropriately added at the time of production of silver halide emulsion particles or at respective stages before coating of the emulsion. However, the rhodium compound is preferably added at the time of formation of the emulsion and integrated into the silver halide particle.

The rhenium, ruthenium or osmium for use in the present invention is added in the form of a water-soluble complex salt described in JP-A-63-2042, JP-A-1-285941, JP-A-2-20852 and JP-A2-20855. A preferred example thereof is a six-coordinate complex salt represented by the following formula:

$$[ML_6]^{n-}$$

wherein M represents Ru, Re or Os, L represents a ligand, and n represents 0, 1, 2, 3 or 4. In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2}$ | $[Re(NO)(CN)_5]^{2-}$ | $[Re(O)_2(CN)_4]^{3-}$ |
| $[RUCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[RU(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The addition amount of these compound is preferably from $1\times10^{-9}$ to $1\times10^{-5}$ mol, more preferably from $1\times10^{-9}$ to $1\times10^{-6}$ mol, per mol of silver halide.

These compounds may be added appropriately at the time of preparation of silver halide emulsion particles or at respective stages before coating of the emulsion, but the compounds are preferably added at the time of formation of the emulsion and integrated into a silver halide particle.

For adding the compound during the particle formation of silver halide and integrating it into a silver halide particle, a method where a metal complex powder or an aqueous solution having dissolved therein the metal complex together with NaCl or KCl is added to a water-soluble salt or water-soluble halide solution during the particle formation, a method where the compound is added as the third solution at the time of simultaneously mixing a silver salt and a halide solution to prepare silver halide particles by the triple jet method, or a method where a necessary amount of an aqueous metal complex solution is poured into a reaction vessel during the particle formation, may be used. Among these, preferred is a method comprising adding a metal complex powder or an aqueous solution having dissolved therein the metal complex together with NaCl or KCl to a water-soluble halide solution.

In order to add the compound to the particle surface, a necessary amount of an aqueous metal complex solution may be charged into a reaction vessel immediately after the particle formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide particles previously doped with iridium may be added and dissolved at the time of preparation of silver halide.

The silver halide particle for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion. However, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount of from $1\times10^{-9}$ to $1\times10^{-4}$ mol per mol of silver halide. The metal may be converted into a metal salt in the form of a simple salt, a composite salt or a complex salt and added at the time of preparation of particles.

The photosensitive silver halide particle may be desalted by water washing according to a method known in the art, such as noodle washing and flocculation, but the particle may not be desalted in the present invention.

It is preferable to use chemical sensitizations for the silver halide emulsion of the invention. As chemical sensitizations, the chemical sensitization may be performed using a known method such as sulfur sensitization, selenium sensitization, tellurium sensitization or noble metal sensitization. These sensitization method may be used alone or in any combination. When these sensitization methods are used as a combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and cold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain. However, it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in Japanese Patent Publication (KOKOKU) (hereinafter referred simply to as "JP-B") 44-15748, JP-B-43-13489, JP-A-Nos. 4-25832, 4-109240 and 4-324855. Among these, particularly preferred are the compounds represented by formulae (VIII) and (IX) of JP-A-4-324855.

The tellurium sensitizer for use in the present invention is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, diacyl tellurides, bis(oxycarbonyl) ditellurides, bis(carbamoyl) ditellurides, compounds having a P═Te bond, tellurocarboxylates, Te-organyltellurocarboxylic acid esters, di(poly)tellurides, tellurides, tellurols, telluroacetals, tellurosulfonates, compounds having a P—Te bond, Te-containing heterocyclic rings, tellurocarbonyl compounds, inorganic tellurium compounds and colloidal tellurium. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, Japanese Patent Application Nos. 3-53693, 4-271341, 4-333043, and 5-303157, J. Chem. Soc. Chem. Commun., 635 (1980), ibid., 1102 (1979), ibid., 645 (1979), J. Chem. Soc. Perkin. Trans., 1, 2191 (1980), S. Patai (compiler), The Chemistry of Organic Selenium and Tellurium Compounds, Vol. 1 (1986), and ibid., Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions. However, it is usually from $10^{-8}$ to $10^{-2}$ mol, preferably on the order of from $10^{-7}$ to $10^{-3}$ mol, per mol of silver halide. The conditions for chemical sensitization in the present invention are not particularly restricted. However, in general, the pH is from 5 to 8, the pAg is from 6 to 11, preferably from 7 to 10, and the temperature is from 40 to 95° C., preferably from 45 to 85° C.

As a noble metal sensitizer used in this invention, gold, platinum, palladium, iridium, and the like can be exemplified, and the gold sensitizer is particularly preferable. As a gold sensitizer used in this invention, chroloaurate, potassium chroloaurate, potassium aurictiocyanate, gold sulfide, and the like can be exemplified, which can be used about $10^{-7}$ to $10^{-2}$ mol per one mol of silver halide.

In the silver halide emulsion for use in the present invention, a cadmium salt, sulfite, lead salt or thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. Also, the reduction sensitization may be performed by introducing a single addition part of silver ion during the formation of grains.

To the silver halide emulsion of the present invention, a thiosulfonic acid compound may be added by the method described in European Patent 293917A.

In the heat developable image-forming material of the present invention, one kind of silver halide emulsion may be used or two or more kinds of silver halide emulsions (for example, those different in the average grain size, different in the halogen composition, different in the crystal habit or different in the chemical sensitization conditions) may be used in combination.

The amount of the photosensitive silver halide used in the present invention is preferably from 0.01 to 0.5 mol, more preferably from 0.02 to 0.3 mol, still more preferably from 0.03 to 0.25 mol, per mol of the organic silver salt. The method and conditions for mixing photosensitive silver halide and organic silver salt which are prepared separately are not particularly limited as far as the effect of the present invention can be brought out satisfactorily. However, a method of mixing the silver halide grains and the organic silver salt after completion of respective preparations in a high-speed stirring machine, a ball mill, a sand mill, a colloid mill, a vibrating mill or a homogenizer or the like, or a method involving preparing organic silver salt while mixing therewith photosensitive silver halide after completion of the preparation in any timing during preparation of the organic silver salt, or the like may be used.

As a method for producing silver halides used for the present invention, the so-called halidation can also be preferably used, in which a part of silver of organic silver salts is halogenated with organic or inorganic halide. While the organic halide compound used for this method is not particularly limited so long as it can react with organic silver salt to form a silver halide, examples thereof include, for example, N-halogenoimides (N-bromosuccinimide etc.), halogenated quaternary nitrogen compounds (tetrabutylammonium bromide etc.), halogenated quaternary nitrogen compounds associated with halogen (pyridinium bromide perbromide etc.) and the like. As for the inorganic halide compound, while it is not particularly limited so long as it can react with organic silver salt to form a silver halide, examples thereof include, for example, alkali metal halides or ammonium halides (e.g, sodium chloride, lithium bromide, potassium iodide, ammonium bromide), alkali earth metal halides (e.g., calcium bromide, magnesium chloride), transition metal halides (ferric chloride, cupric bromide etc.), metal complexes having halogen ligands (sodium bromoiridate, ammonium chlororhodate etc.), halogen atoms (bromine, chlorine, iodine etc.) and the like. The organic and inorganic halides can be used in a desired combination.

The amount of the halide compounds when the halidation is used for the present invention is preferably 1 mM to 500 mM, more preferably 10 mM to 250 mM in terms of halogen atom per 1 mol of the organic silver salt.

The organic silver salt which can be used in the present invention is a silver salt which is relatively stable against light but forms a silver image when it is heated at 80° C. or higher in the presence of an exposed photocatalyst (e.g., a latent image of light-sensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, of which ligand has a complex stability constant of from 4.0 to 10.0, is also preferred. The silver-supplying substance may constitute preferably from about 5 to 70% by weight of the image-forming layer. The preferred organic silver salt includes a silver salt of an organic compound having a carboxyl group. Examples thereof include an aliphatic carboxylic acid silver salt and an aromatic carboxylic acid silver salt. However, the present invention is by no means limited thereto. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

Silver salts of compounds having a mercapto or thione group and derivatives thereof may also be used as the organic silver salt. Preferred examples of these compounds include a silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as silver salt of dithioacetic acid, silver salts of thioamides, silver salt of 5-carboxyl-1-methyl-2-phenyl-4-thiopyridine, silver salts of mercaptotriazines, silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited but an acicular crystal form having a short axis and a long axis is preferred. In the present invention, the short axis is preferably from 0.01 to 0.20 $\mu$m, more preferably from 0.0 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined by the image of an organic silver salt dispersion observed through a transmission type electron microscope. Another method for determining the monodispesibility is a method involving obtaining the standard deviation of a volume load average diameter of the organic silver salt. The percentage (coefficient of variation) of the value obtained by dividing the standard deviation by the volume load average diameter is preferably 100% or less, more preferably 80% or less, still more preferably 50% or less. The grain size (volume load average diameter) for determining the monodispersibility may be obtained, for example, by irradiating a laser ray on an organic silver salt dispersed in a solution and determining an autocorrelatlon function of the fluctuation of the scattered light to the change in time.

The organic silver salt usable in this invention is preferably subject to desalting. There is no special limitation to methods for desalting, and known methods can be used. It is preferable to use known filtering methods such as centrifugal filtering, absorbing filtering, ultrafiltration, frock forming washing by cohesion method, and so on.

The organic silver salt that can be used for the present invention is converted into a dispersion of solid microparticles using a dispersant in order to obtain coagulation-free microparticles of a small size. The organic silver salt can be mechanically made into a dispersion of solid microparticles by using a known means for producing microparticles (for example, ball mill, vibrating ball mill, planet ball mill, sand mill, colloid mill, jet mill, roller mill, high pressure homogenizer) in the presence of a dispersing aid.

When the organic silver salt is made into microparticles by using a dispersant, the dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers, semisynthetic anionic polymers such as carboxymethylated starch and carboxymethylcellulose, anionic polymers such as alginic acid and pectic acid, anionic surfactants such as those disclosed in JP-A-52-92716, WO88/04794 and the like, compounds disclosed in JP-A-9-179243, known anionic, nonionic and cationic surfactants, other known polymers such as polyvinyl alcohol, polyvinylpyrrolidone, carboxymethylcellulose, hydroxypropylcellulose, and hydroxypropylmethylcellulose, naturally occurring polymers such as gelatin and the like.

The dispersing aid is generally mixed with the organic silver salt in a form of powder or wet cake before the dispersing operation, and fed as slurry into a dispersing apparatus. However, it may be mixed with the organic silver salt beforehand, and subjected to a treatment by heating, with solvent or the like to form organic silver salt powder or wet cake. The pH may be controlled with a suitable pH modifier during or after the dispersing operation.

Other than the dispersing operation by a mechanical means, the organic silver salt can be made into microparticles by roughly dispersing it in a solvent through pH control, and then changing the pH in the presence of a dispersant. For this operation, an organic solvent may be used as the solvent for roughly dispersing the organic silver salt, and such an organic solvent is usually removed after the formation of microparticles.

The produced dispersion can be stored with stirring in order to prevent precipitation of the microparticles during storage, or stored in a highly viscous state formed with a hydrophilic colloids (e.g., a jelly state formed with gelatin). Further, it may be added with a preservative in order to prevent saprophytic proliferation during the storage.

While the organic silver salt can be used for the present invention at any desired amount, it is preferably used in an amount of 0.1 to 5 g/m$^2$, more preferably 1 to 3 g/m$^2$ per square meter of the heat developable image recording material.

The heat developable image recording material of the present invention contains a reducing agent for organic silver salt. The reducing agent for organic silver salt may be any substance, preferably an organic substance, which reduces the silver ion to metal silver. Conventional photographic developers such as phenidone, hydroquinone and catechol are useful, but a hindered phenol reducing agent is preferred. The reducing agent is preferably contained in an amount of from 5 to 50% by mol, more preferably from 10 to 40% by mol, per mol of silver on the surface having an image-forming layer. The layer to which the reducing agent is added may be any layer on the surface having an image-forming layer. In the case of adding the reducing agent to a layer other than the image-forming layer, the reducing agent is preferably used in a slightly large amount of from 10 to 50% by mol per mol of silver. The reducing agent may also be a so-called precursor which is derived to effectively exhibit the function only at the time of development.

For the heat developable light-sensitive material using an organic silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent 692732 and the like. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxyl-1,1'-binaphthyl, 6,6'-dibromo-2,2'-dihydroxy-1,1-binaphthyl and bis(2-hydroxy-1-naphthyl) methane; combinations of a bis-β-naphthol with a 1,3-dihydroxybenzene derivative (e.g., 2',4'-dihydroxybenzophenone, 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimpercapto-1,3,4-thiadiazole; N-(aminomethyl)aryidicarboxyimides such as N,N-(dimethylaminomethyl)phthalimide and N,N'-(dimethylaminomethyl)naphthalene-2,3-dicarboxyimide; pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis (isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazlnone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (derivatives such as e.g., 4-(1-naphthyl)phthalazine, 6-chlorophthalazinone, 5,7-dimethoxyphthalazine, isopropylphthalazine, 6-iso-butylphthalazine, 6-tertbutylphthalazine, 5,7-dimethylphthalazine, and 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1 ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent of the present invention may be added in any form of a solution, powder and a solid microparticle dispersion. The solid microparticle dispersion is performed using a known pulverizing means (e.g., ball mill, vibrating ball mill, sand mill, colloid mill, jet mill, roller mill). At the time of solid microparticle dispersion, a dispersion aid may also be used.

When an additive known as a "color toner" capable of improving the image is added, the optical density increases in some cases. Also, the color toner is advantageous in forming a black silver image defending on the case. The color toner is preferably contained on the surface having an image-forming layer in an amount of from 0.1 to 50% by mol, more preferably from 0.5 to 20% by mol, per mol of silver. The color toner may be a so-called precursor which is derived to effectively exhibit the function only at the time of development.

For the heat developable light-sensitive material using an organic silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795 and Belgian Patent No. 841910. Examples of the color toner include phthalimide and hydroxyphthalimide; succinimide, pyrazolin-5-ones and cyclic as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

The color toner of the present invention may be preferably added with a water solution, but in the case that the toner is water-insoluble, the toner can be added in any form of, e.g., a methanol solution, powders, solid microparticle dispersion and the like. The solid fine particle dispersion is performed using a known pulverization means (e.g., ball mill, vibrating ball mill, sand mill, colloid mill, jet mill, roller mill). At the time of solid microparticle dispersion, a dispersion aid may also be used.

Now, substituted alkene derivatives, substituted isooxazole derivatives, and specific acetal compounds, represented by Formula (1) to Formula (3) and used as nucleation agents in the present invention are described.

(1)

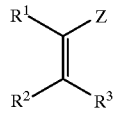

(2)

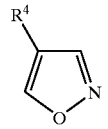

(3)

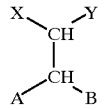

In Formula (1), $R^1$, $R^2$ and $R^3$ each independently represents a hydrogen atom or a substituent; Z represents an electron withdrawing group. In Formula (1), $R^1$ and Z, $R^2$ and $R^3$, $R^1$ and $R^2$, or $R^3$ and Z may be combined with each other to form a ring structure. In Formula (2), $R^4$ represents a substituent. In Formula (3), X and Y each independently represents a hydrogen atom or a substituent; A and B each independently represents an alkoxy group, an alkylthio croup, an alkylamino group, an aryloxy group, an arylthio group, an anilino group, a heterocyclic oxy group, a heterocyclic thio group or a heterocyclic amino group. In Formula (3), X and Y, or A and B may be combined with each other to form a ring structure.

In Formula (1), $R^1$, $R^2$ and $R^3$ each independently represents a hydrogen atom or a substituent, and Z represents an electron withdrawing group or a silyl group. In Formula (1), $R^1$ and Z, $R^2$ and $R^3$, $R^1$ and $R^2$, or $R^3$ and Z may be combined with each other to form a ring structure.

When $R^1$, $R^2$ or $R^3$ represents a substituent, examples of the substituent include a halogen atom (e.g., fluorine, chlorine, bromide, iodine), an alkyl group (including, e.g., an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group or a salt thereof, an alkoxy group (including a group containing an ethyleneoxy group or propyleneoxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, an acylamino group, a sulfonamide group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group or a salt thereof, an (alkyl, aryl or heterocyclic)thio group, an acylthio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These substituents each may further be substituted by any of the above-described substituents.

The electron withdrawing group represented by Z in Formula (1) is a substituent having a Hammett's substituent constant op of a positive value, and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamide group, a sulfonamide group, an acyl group, a formyl group, a phosphoryl group, a carboxy group, a sulfo group (or a salt thereof), a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, an urazole-1-yl group, a succinimido group and a phthalimido group. The electron withdrawing group represented by Z in Formula (1) may have a further substituent or substituents.

The electron withdrawing group represented by Z in Formula (1) is preferably a group having a 0–30 total carbon atom number such as a cyano group, an alkoxycarbonyl group, an aryloxycarbonyl group, a carbamoyl group, a thiocarbonyl group, an imino group, an imino croup substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, a thiocarbonyl group, an imino group, an imino group substituted by N atom, a sulfamoyl group, an alkylsulfonyl group, an arylsulfonyl group, an acyl group, a formyl group, a phosphoryl group, a trifluoromethyl group or a phenyl group substituted by any electron withdrawing group, further more preferably a cyano group, an alkoxycarbonyl group, a carbamoyl group, an imino group, an imino group substituted by N atom, an alkylsulfonyl group, an arylsulfonyl group, an acyl group, a formyl group.

The substituent represented by $R^1$ in Formula (1) is preferably a group having a 0–30 total carbon atom number and specific examples of the group include a group having the same meaning as the electron withdrawing group represented by Z in Formula (1), an alkyl group, an alkenyl group, an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an acylamino group, a silyl group and a substituted or unsubstituted aryl group, more preferably, a group having the same meaning as the electron withdrawing group represented by Z in Formula (1), a substituted or unsubstituted aryl group, an alkenyl group, an alkylthio group, an arylthio group, an alkoxy group, a silyl group, and an acylamino group, further more preferably, the electron withdrawing group, an aryl group, an alkenyl group, and an acylamino group.

When $R^1$ represents the electron withdrawing group, a desirable range is the same as the desirable range of the electron withdrawing group represented by Z.

The substituent represented by $R^2$ or $R^3$ in Formula (1) is preferably a group having the same meaning as the electron withdrawing group represented by Z in above Formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylthio group, an anilino group, a heterocyclic amino group, an acylamino group or a substituted or unsubstituted phenyl group. with the $R^2$ and $R^3$, either one is more preferably, a hydrogen atom and the other is a substituent. The substituent is preferably an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamide group), a sulfonamide group, a substituted or unsubstituted phenyl group or a heterocyclic group, more preferably a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, or a heterocyclic group, still more preferably a hydroxy group (or a salt thereof), an alkoxy group or a heterocyclic group.

In Formula (1), it is also preferred that Z and $R^1$ or $R^2$ and $R^3$ form a ring structure. The ring structure formed is a non-aromatic carbocyclic ring or a non-aromatic heterocyclic ring, preferably a 5-, 6- or 7-membered ring structure having a total carbon atom number including those of substituents of from 1 to 40, more preferably from 3 to 35.

One preferred compound among the compounds represented by Formula (1) is a compound where Z represents a cyano group, a formyl group, an acyl group, an alkoxycarbonyl group, an imino group or a carbamoyl group, $R^1$ represents an electron withdrawing group, and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, or a heterocyclic group. Furthermore, one preferred compound among the compounds represented by Formula (1) is a compound where Z and $R^1$ form a non-aromatic 5-, 6- or 7-membered ring structure in a combincation and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group an amino group, or a heterocyclic group.

Herein, the non-aromatic five to seven-membered ring structure are, specifically, indane-1,3-dioncyclic ring, pyrolidine-2,4-dion ring, pyrazolidine-3,5-dion ring, oxazolidine-2,4-dion ring, 5-pyrazolone ring, imidazolidine-2,4-dion ring, thiazolidine-2,4-dion ring, oxolane-2,4-dion ring, thiolane-2,4-dion ring, 1,3-dioxane-4,6-dion ring, cyclohexane-1,3-dion ring, 1,2,3,4-tetrahydroquinoline-2,4-dion ring, cyclopentane-1,3-dion ring, iso-oxazolidine-3,5-dion ring, barbituric acid ring, 2,3-dihydrobenzofuran-3-on ring, pyrazolotriazole ring (e.g., 7H-pyrazolo[1,5-b][1,2,4]triazole, 7H-pyrazolo[5,1-c][1,2,4]triazole, 7H-pyrazolo[1,5-a][1,2,4]benzimidazole), pyrrolotriazole ring (e.g., 5H-pyrrolo[1,2-b][1,2,4]triazole, 5H-pyrrolo[2,1-c][1,2,4]triazole), 2-cyclopentene-1,4-dion ring, 2,3-dihydrobenzothiophene-3-on-1,1-dioxide ring, chromane-2,4-dion ring, 2-thion, ring, pyrrolopyrimidion ring, 1,3-dithiolane ring, thiazolidine ring, 1,3-dithiethane ring, 1,3-dioxolane ring. Preferred are, e.g., inter alia, indane-1,3-dioncyclic ring, pyrolidine-2,4-dion ring, pyrazolidine-3,5-dion ring, 5-pyrazolone ring, barbituric acid ring, and 2-oxazolidine-5-on ring.

As examples of a substituent represented by $R^4$ in Formula (2), the same substances can be exemplified as those described for the substituents of $R^1$ to $R^3$ in Formula (1).

The substituent represented by $R^4$ in Formula (2) is preferably an electron withdrawing group or an aryl group. When $R^4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a perfluoroalkyl group, a phosphoryl group, an imino group or a heterocyclic group, more preferably a cyano group, an acyl group, a formyl group, an alkoxycarbonyl group, a carbamoyl group, a sulfamoyl group, an alkylsulfonyl group, an arylsulfonyl group or a sulfonamide, or a heterocyclic group.

When $R^4$ represents an aryl group, the aryl group is preferably a substituted or unsubstituted phenyl group having a total carbon atom number of from 0 to 30. As for substituent, when $R^1$, $R^2$ or $R^3$ in Formula (1) represents a substituent, the same substituent can be exemplified but such a substituent is preferably an electron withdrawing group.

In Formula (3), the substituent represented by X or Y can be the same one described for the substituent for $R^1$, $R^2$, and $R^3$ in Formula (1). The substituent represented by X or Y is preferably a substituent having a total carbon number of from 1 to 50, more preferably from 1 to 35, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group. More preferred are a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, and further more preferred are a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted by N atom, a heterocyclic group or a phenyl group substituted by any electron withdrawing group.

X and Y are also preferably combined with each other to form a non-aromatic carbon ring or a non-aromatic heterocyclic ring. The ring structure formed is preferably a 5-, 6-, or 7-membered ring, and more specifically, the rings can be the same as the examples of 5-, 6- or 7-membered ring of the non-aromatic groups to be formed in combination of Z and $R^1$ in Formula (1) and have the same desirable range. Those rings may include a substituent, whose total carbon atom number is preferably from 1 to 40, more preferably from 1 to 35.

Those groups represented by A and B in Formula (3) may further have a substituent, and preferably, the group has a total carbon atom number from 1 to 40, more preferably from 1 to 30.

In Formula (3), A and B are more preferably combined with each other to form a ring structure. The ring structure formed is preferably a 5-, 6- or 7-membered non-aromatic heterocyclic ring having a total carbon atom number of from 1 to 40, more preferably from 3 to 30. In this situation, examples of the linked structure (—A—B—) formed by A and B include —O—$(CH_2)_2$—O—, —O—$(CH_2)_3$—O—, —S—$(CH_2)_2$—S—, —S—$(CH_2)_3$—S—ph—S—, —N$(CH_3)$—$(CH_2)_2$—O—, —N$(CH_3)$—$(CH_2)_2$—S—, —O—$(CH_2)_3$—S—, —N$(CH_3)$—ph—O—, —N$(CH_3)$—ph—S— and —N(ph)—$(CH_2)_2$—S—.

Into the compound represented by Formula (1), (2) or (3) for use in the present invention, an adsorptive group capable of adsorbing to silver halide may be integrated. Also, a ballast group or polymer commonly used in immobile photographic additives such as a coupler may be integrated into the compound. The compound may contain a cationic group (specifically a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoyl sulfamoyl group). Examples of the groups include the groups described in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JP-A-5-333466, JP-A-6-19032, JP-A-6-19031, JP-A-545761, U.S. Pat. Nos. 4,994,365 and 4,988,604, JP-A-3-259240, JP-A-7-5610, JP-A-7-244348 and German Patent No. 4,006,032.

Specific examples of the compounds represented by Formulae (1) to (3) for use in the present invention are shown below. However, the present invention is by no means limited to the following compounds.

C-1

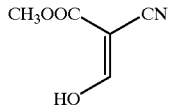

C-2

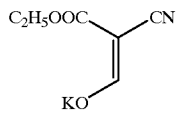

-continued
C-3
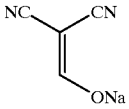
C-4
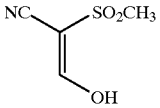
C-5
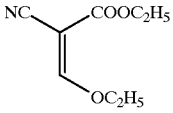
C-6
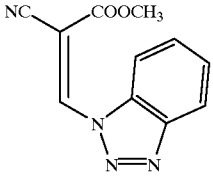
C-7
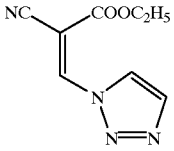
C-8
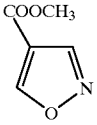
C-9
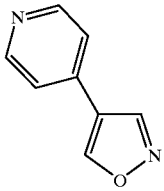
C-10
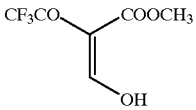
C-11
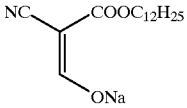
C-12
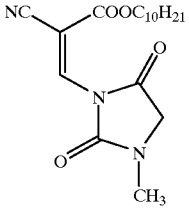
-continued
C-13
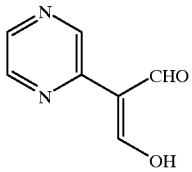
C-14
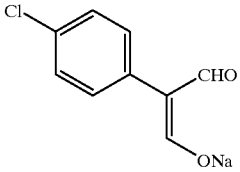
C-15
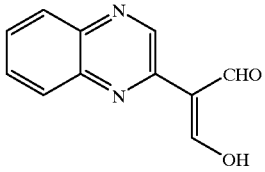
C-16
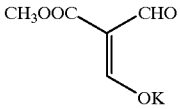
C-17
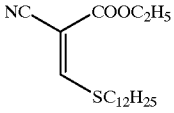
C-18
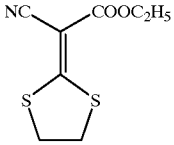
C-19
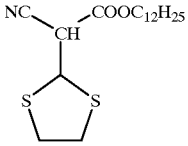
C-20
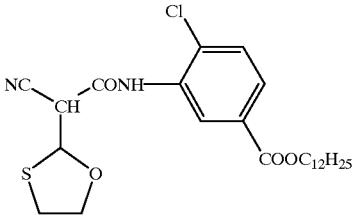
C-21
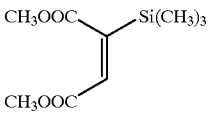

-continued
C-22
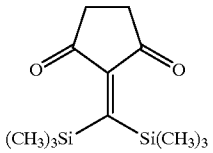
C-23
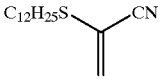
C-24
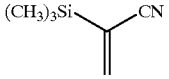
C-25
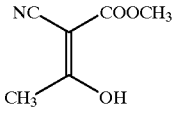
C-26
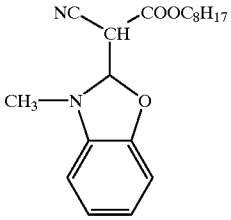
C-27
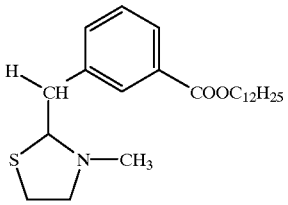
C-28
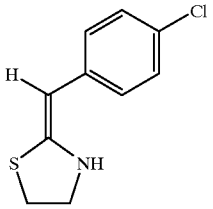
C-29
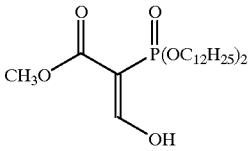
C-30
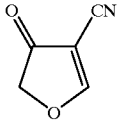
-continued
C-31
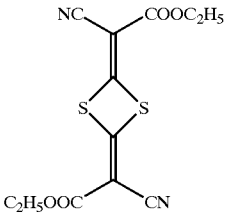
C-32
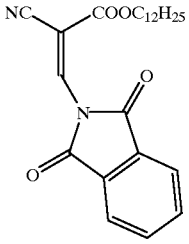
C-33
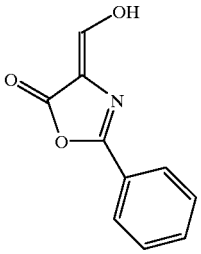
C-34
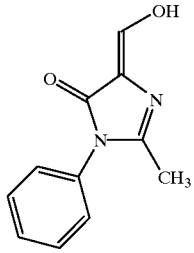
C-35
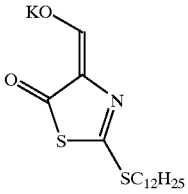
C-36
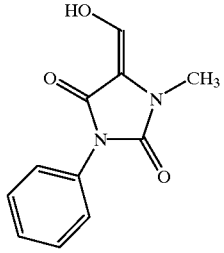

-continued
C-37
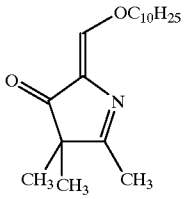
C-38
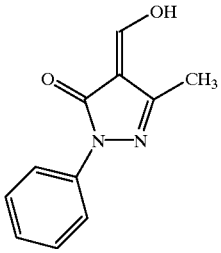
C-39
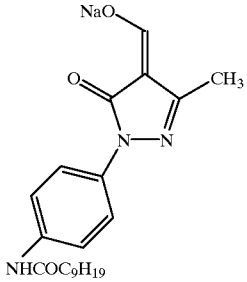
C-40
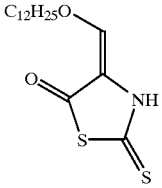
C-41
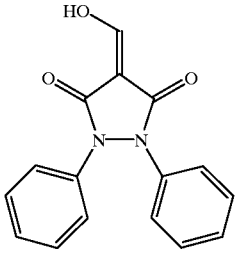
C-42
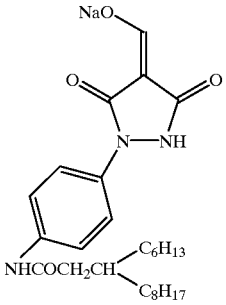
-continued
C-43
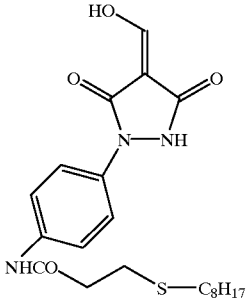
C-44
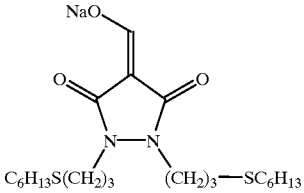
C-45
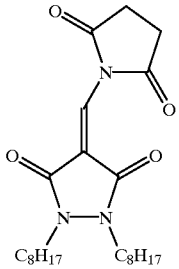
C-46
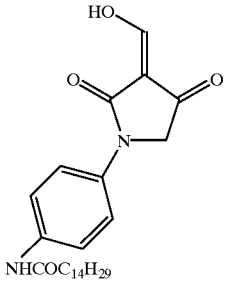
C-47
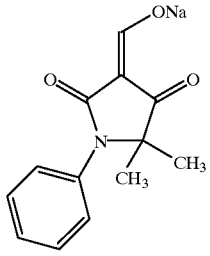

-continued
C-48
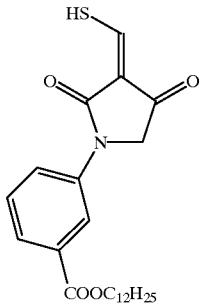
C-49
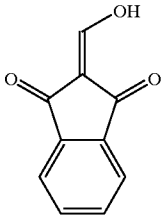
C-50
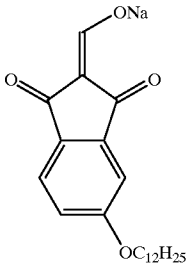
C-51
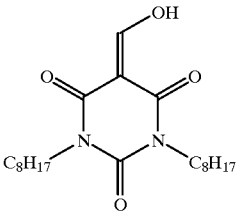
C-52
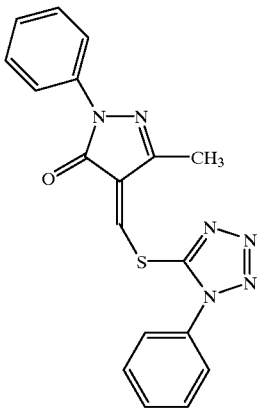
-continued
C-53
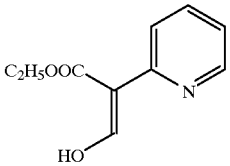
C-54
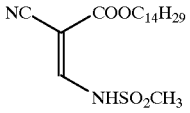
C-55
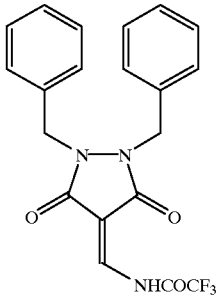
C-56
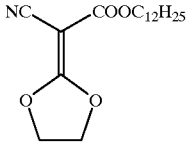
C-57
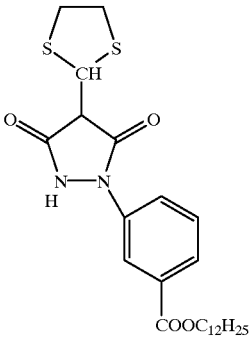
C-58
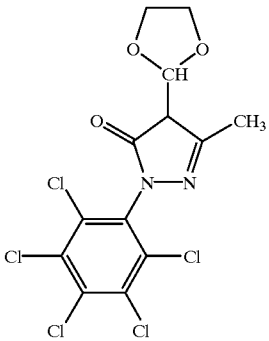

C-59
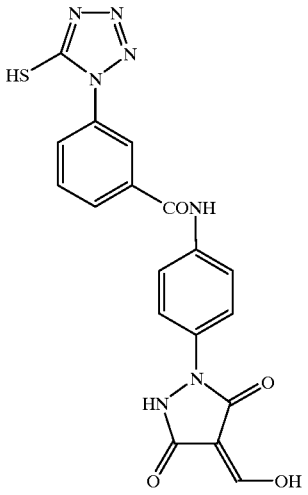
C-60
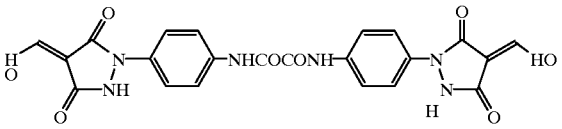
C-61
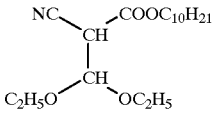
C-62
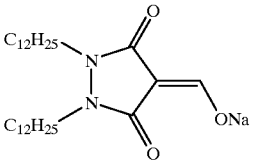
C-63
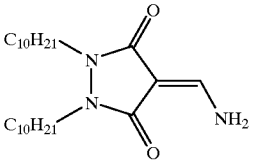
C-64
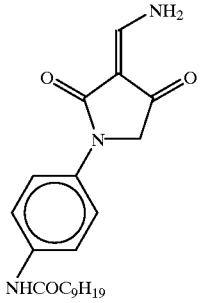
C-65
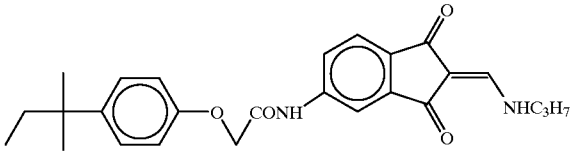
C-66
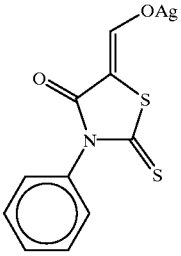
C-67
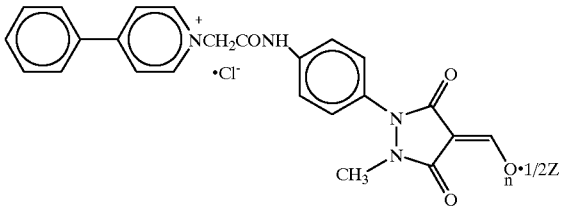
C-68
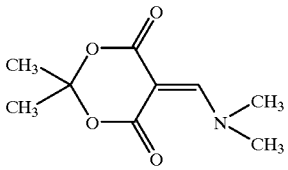
C-69
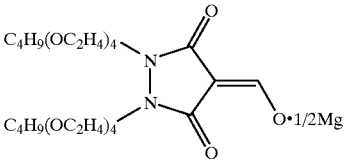
C-70
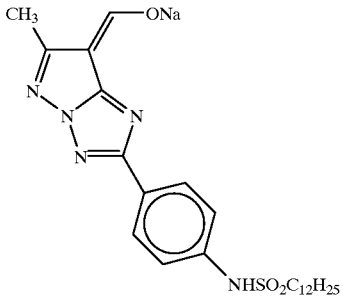

-continued

C-71

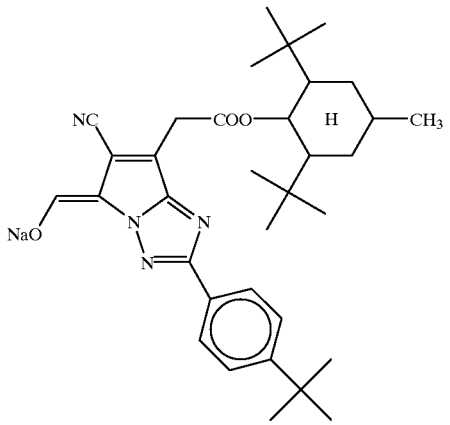

C-72

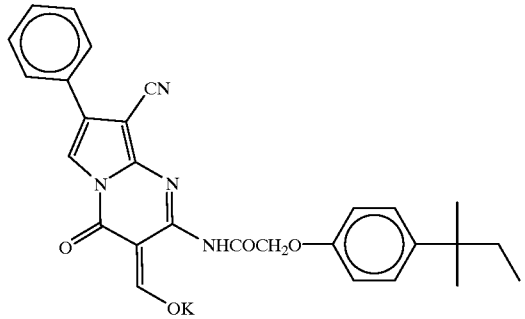

The compounds represented by Formulae (1) to (3) can be easily synthesized according to known methods and may be synthesized by referring, for example, to U.S. Pat. Nos. 5,545,515, 5,635,339 and 5,654,130, International Patent Publication WO97/34196 or Japanese Patent Application Nos. 9-354107, JP-A-11-133546 and JP-A-11-95365.

The compounds represented by Formulae (1) to (3) may be used individually or in combination of two or more thereof. In addition to these compounds, compounds described in U.S. Pat. Nos. 5,545,515, 5,635,339 and 5,654,130, U.S. Pat. No. 5,705,324, U.S. Pat. No. 5,686,228, JP-A-10-161270, JP-A-11-119372, Japanese Patent Application No. 9-354107, JP-A-133,546, JP-A-11-119373, JP-A-11-109546, JP-A-11-95365, JP-A-11-95366, and JP-A-11-149136.

In the present invention, various hydrazine derivatives as described in JP-A-10-161270 can be incorporated.

The compounds represented by Formulae (1) to (3) for use in the present invention each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the compounds each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds each may be used after dispersing the powder of the compound in an appropriate solvent such as water by a method known as a solid dispersion method, using a ball mill, a colloid mill or an ultrasonic wave.

The compounds represented by Formulae (1) to (3) for use in the present invention each may be added to a layer in the image forming layer side on the support, namely, an image-forming layer, or any other layers; however, the compounds each is preferably added to an image-forming layer or a layer adjacent thereto.

The addition amount of the compound represented by Formula (1), (2) or (3) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mol of silver.

In the present invention, various hydrazine derivatives as described in JP-A-10-161270 can be incorporated.

The hydrazine derivative desirably used in the present invention is preferably a compound represented by below Formula (H).

(H)

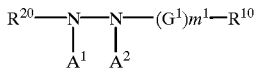

In Formula, $R^{20}$ represents an aliphatic group, an aromatic group or a heterocyclic group, $R^{10}$ represents a hydrogen atom or a block group,. $G^1$ represents —CO—, —COCO—, —C(=S)—, —$SO_2$—, —SO—, —PO($R^{30}$)— (wherein $R^{30}$ is a group selected from the groups within the range defined for $R^{10}$, and $R^{30}$ may be different from $R^{10}$), or an iminomethylene group. Both of $A^1$ and $A^2$ represent a hydrogen atom or one represents a hydrogen atom whereas the other represents a substituted or unsubstituted alkylsulfonyl group, a substituted or unsubstituted arylsulfonyl group, or a substituted or unsubstituted acyl group. A numeral $m^1$ represents 0 or 1 and when $m^1$ is 0, $R^{10}$ represents an aliphatic group, an aromatic group or a heterocyclic group.

Subsequently, the hydrazine derivatives used in the invention as represented by Formula (H) are described.

In Formula (H), the aliphatic group represented by $R^{20}$ is preferably a substituted or unsubstituted, linear, branched or cyclic alkyl group, an alkenyl group or an alkynyl group having from 1 to 30 carbon atoms.

The aromatic group represented by $R^{20}$ is a monocyclic or condensed cyclic aryl group, and examples thereof include, e.g., a phenyl group and a naphthalene group derived from a benzene ring and a naphthalene ring, respectively. The heterocyclic group represented by $R^{20}$ is a monocyclic or condensed cyclic, saturated or unsaturated, aromatic or non-aromatic heterocyclic group, and examples thereof include a pyridine ring, a pyrimidine ring, an imidazole ring, a pyrazole ring, a quinoline ring, an isoquinoline ring, a benzinidazole ring, a thiazole ring, a benzothiazole ring, a thiophene ring, a triazine ring, a morpholino ring, a piperidine ring and a piperazine ring, and a benzo[1,3]dioxole ring The compound $R^{20}$ can be substituted with an arbitrary substituent.

$R^{20}$ is preferably an aryl group, an alkyl group, or an aromatic heterocyclic group, more preferably, a saturated or unsaturated phenyl group, a substituted alkyl group having a carbon number from one to three, or an aromatic heterocyclic group.

When $R^{20}$ represents a substituted alkyl group having a carbon number from one to three, $R^{20}$ is more preferably a substituted methyl group, particularly, a doubly substituted methyl group or triply substituted methyl group. When $R^{20}$ represents a substituted alkyl group, preferred examples are a t-butyl group, a dicyanomethyl group, a dicyanophenylmethyl group, a triphenylmethyl group (trityl group) diphenylmethyl group, a methoxycarbonyldiphenylmethyl group, a dicyanodiphenylmehyl group, a methylthiodiphenylmehyl group, and cyclopropyldiphenylmethyl group, and the like, and a trityl group among those is most preferable.

When $R^{20}$ represents an aromatic heterocyclic group, exemplified as a preferable heterocyclic group are, e.g., a pyridine ring, a quinoline ring, a pyrimidine ring, a triazine ring, a benzothiazole ring, a benzimidazole ring, and a thiophene ring.

In Formula (H), $R^{20}$ is, most preferably a substituted or non-substituted phenyl group.

In Formula (H), $R^{11}$ represents a hydrogen atom or a block group. The block group is specifically an aliphatic group (specifically, an alkyl group, an alkenyl group or an alkynyl group), an aromatic group (e.g., a monocyclic or condensed cyclic aryl group), a heterocyclic group, an alkoxy group, an aryloxy group, an amino group or a hydrazino group.

The alkyl group represented by $R^{11}$ is preferably a substituted or unsubstituted alkyl group having from 1 to 10 carbon atoms, and examples thereof include a methyl group, an ethyl group, a trifluoromethyl group, a difluoromethyl group, a 2-carboxytetrafluoroethyl group, a pyridiniomethyl group, a difluoromethoxymethyl group, a difluorocarboxymethyl group, a hydroxymethyl group, a methanesulfonamidomethyl group, a benzenesulfonamidomethyl group, a trifluorosulfonamidomethyl group, a trifluoroacetylmethyl group, a dimethylaminomethyl group, a phenylsulfonylmethyl group, an o-hydroxybenzyl group, a methoxymethyl group, a phenoxymethyl group, a 4-ethylphenoxymethyl group, a phenylthiomethyl group, a t-butyl group, a dicyanomethyl group, a diphenylmethyl group, a triphenylmethyl group, a methoxycarbonyldiphenylmethyl group, a cyanodiphenylmethyl group and a methylthiodiphenylmethyl group. The alkenyl group is preferably an alkenyl group having from 1 to 10 carbon atoms, and examples thereof include a vinyl group, a 2-ethoxycarbonylvinyl group, a 2-trifluoro-2-methoxycarbonylvinyl group, a 2,2-dicyanovinyl group, a 2-cyano-2-methoxycarbonylvinyl group, a 2-cyano-2-ethoxycarbonylvinyl group, and a 2-acetyl-2-ethoxycarbonylvinyl group. The aryl group is preferably a monocyclic or condensed cyclic aryl group, more preferably an aryl group containing a benzene ring, and examples thereof include a phenyl group, a perfluorophenyl group, a 3,5-dichlorophenyl group, a 2-methanesulfonamidophenyl group, a 2-carbamoylphenyl group, a 4,5-dicyanophenyl group, a 2-hydroxymethylphenyl group, 2,6-dichloro-4-cyanophenyl group and 2-chloro-5-octylsulfamoylphenyl group. The heterocyclic group is preferably a 5- or 6-membered, saturated or unsaturated, monocyclic or condensed heterocyclic group containing at least one nitrogen, oxygen or sulfur atom, and examples thereof include a morpholino group, a piperidino group (N-substituted), an imidazolyl group, an indazolyl group (e.g., 4-nitroindazolyl group), a pyrazolyl group, a triazolyl group, a benzoimidazolyl group, a tetrazolyl group, a pyridyl group, a pyridinio group, a quinolinio group, a quinolyl group, a hydantoyl group, and an imidazolidinyl group. The alkoxy group is preferably an alkoxy group having from 1 to 8 carbon atoms, and examples thereof include a methoxy group, a 2-hydroxyethoxy group, a benzyloxy group and a t-butoxy group. The amino group is preferably an unsubstituted amino group, an alkylamino group having from 1 to 10 carbon atoms, an arylamino group or a saturated or unsaturated heterocyclic amino group (including a nitrogen-containing heterocyclic amino group containing a quaternized nitrogen atom). Examples of the amino group include 2,2,6,6-tetramethylpiperidin-4-ylamino group, a propylamino group, a 2-hydroxyethylamino group, a 3-hydroxypropylmino group, an anilino group, an o-hydroxyanilino group, a 5-benzotriazolylamino group and an N-benzyl-3-pyridiricamino group. The group represented by $R^{10}$ may be substituted with an arbitrary substituent.

The preferred group represented by $R^{20}$ is described below. When $R^{20}$ is a phenyl group or an aromatic heterocyclic ring and $G^1$ is —CO— group, $R^{10}$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. In the case where $R^{10}$ represents an alkyl group, the substituent therefor is particularly preferably a halogen atom, an alkoxy group, an aryloxy group, an alkylthio group, an arylthio group, a carboxy group, a sulfonamide group, an amide group, acylamino group, and a carboxy group.

When $R^{20}$ is a substituted methyl group and $G^1$ is —CO— group, $R^{10}$ is preferably a hydrogen atom, an alkyl group, an aryl group, a heterocyclic group, an alkoxy group or an amino group (e.g., unsubstituted amino group, alkylamino group, arylamino group, heterocyclic amino group), more Preferably a hydrogen atom, an alkyl group, an aryl group, a heterocyclic group, an alkoxy group, an alkylamino group, an arylamino group or a heterocyclic amino group. When $G^1$ is —COCO— group, $R^{10}$ is preferably, irrespective of $R^{20}$, an alkoxy group, an aryloxy group or an amino group, more preferably a substituted amino group, specifically, an alkylamino group, an arylamino group or a saturated or unsaturated heterocyclic amino group.

When $G^1$ is —$SO_2$— group, $R^{10}$ is preferably, irrespective of $R^{20}$, an alkyl group, an aryl group or a substituted amino group.

In Formula (H), $G^1$ is preferably —CO— or —COCO— group, more preferably —CO— group.

In Formula (H), $A^1$ and $A^2$ each represents a hydrogen atom, an alkyl group or arylsulfonyl group having 20 or less carbon atoms (preferably a phenylsulfonyl group or a phenylsulfonyl group substituted such that the sum of Hammett's substituent constants is −0.5 or more), an acyl group having 20 or less carbon atoms (preferably a benzoyl group, a benzoyl group substituted such that the sum of Hammett's substituent constants is −0.5 or more, or a straight-chain, branched or cyclic, substituted or unsubstituted aliphatic acyl group). $A^1$ and $A^2$ each is most preferably a hydrogen atom.

In Formula (H), $m^1$ represents 1 or 0. When $m^1$ is 0, $R^{10}$ is an aliphatic group, an aromatic group or a heterocyclic group, preferably a phenyl group, a substituted alkyl group having from 1 to 3 carbon atoms, or an alkenyl group. The phenyl group and the substituted alkyl group having from 1 to 3 carbon atoms among these groups have the same preferred range as described above for $R^{20}$. When $R^{10}$ belongs to an alkenyl group, $R^{10}$ is preferably a vinyl group and is further preferred to be a vinyl group having one or two substituents selected from the following substituents: a cyano group, an acyl group, an alkoxycarbonyl group, a nitro group, a trifluoromethyl group, a carbamoyl group, and the like. More specifically, $R^{10}$ may be selected from a group of a 2,2-dicyanovinyl group, 2-cyano-2-methoxycarbonylvinyl group, a 2-cyano-ethoxycarbonylvinyl group, and a 2-acetyl-ethoxycarbonylvinyl group.

Numeral $m^1$ is preferably 1.

In Formula (H), $R^{10}$ be one which cleaves the $G^1$—$R^{10}$ moiety from the residual molecule and causes a cyclization reaction to form a cyclic structure containing the atoms in the —$G^1$—$R^{10}$ moiety. Also, into the hydrazine derivative represented by Formula (H), an adsorptive group capable of adsorbing to silver halide may be integrated. Numeral $R^{10}$ or $R^{20}$ in Formula (H) may be one into which a ballast group or polymer commonly used in immobile photographic additives such as a coupler may be integrated. The $R^{10}$ or $R^{20}$ in Formula (H) may contain a plurality of hydrazino groups serving as the substituents. At this time, the compound represented by Formula (H) is a polymer product with respect to the hydrazino group. Moreover, the $R^{10}$ or $R^{20}$ in Formula (H) may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group). Examples thereof include those compounds described in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, JP-A-2-285344, JP-A-1-100530, JP-A-64-86134, JP-A-4-16938, JP-A-5-197091, WO95-32452, WO95-32453, JP-A 9-235264, JP-A-9-235265, JP-A 9-235266, JP-A-9-235267, JP-A 9-179229, JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

The followings are specific examples o-f compounds shown by Formula (H) However, this invention is not limited to those compounds.

TABLE 1
| | Y—NHNH—X | | | | |
|---|---|---|---|---|---|
| | X = | | | | |
| Y = | —CHO | —$COCH_2OH$ | —$COCH_2NHSO_2CH_3$ | —$COCH_2N(CH_3)_2$ | —$CH{=}C(CN)COOC_2H_5$ |
| 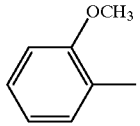 | 1a | 1b | 1c | 1d | 1e |
| 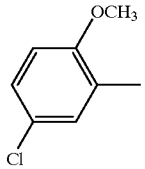 | 2a | 2b | 2c | 2d | 2e |
| 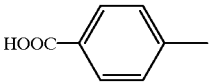 | 3a | 3b | 3c | 3d | 3e |
| 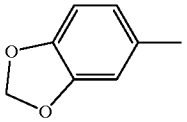 | 4a | 4b | 4c | 4d | 4e |
| 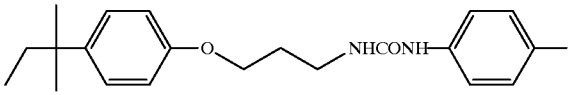 | 5a | 5b | 5c | 5d | 5e |

TABLE 2
Y-NHNH-X
| Y = | X = 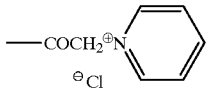 | 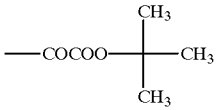 | 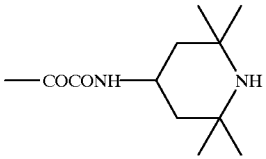 | $—COCHF_2$ | $—COC_2F_4COOK$ |
|---|---|---|---|---|---|
| 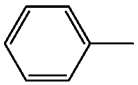 | 6a | 6b | 6c | 6d | 6e |
| 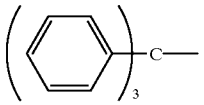 | 7a | 7b | 7c | 7d | 7e |
| 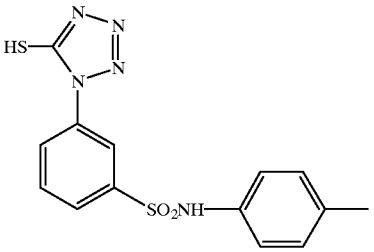 | 8a | 8b | 8c | 8d | 8e |

TABLE 2-continued
| | Y-NHNH-X | | | | |
|---|---|---|---|---|---|
| | X = | | | | |
| Y = | —$COCH_2^{\oplus}N$ (pyridinium) $^{\ominus}Cl$ | —COCOO—$C(CH_3)_3$ | —COCONH— (2,2,6,6-tetramethylpiperidyl-4-amino) | —$COCHF_2$ | —$COC_2F_4COOK$ |
| 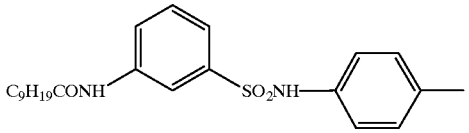 | 9a | 9b | 9c | 9d | 9e |
| 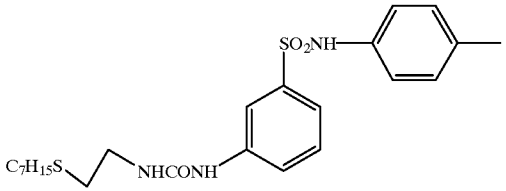 | 10a | 10b | 10c | 10d | 10e |

TABLE 3
11
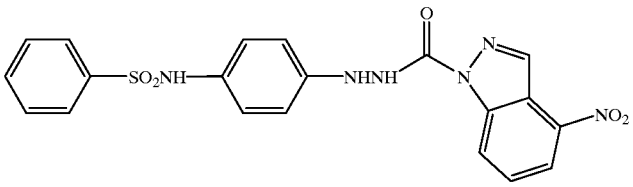
12
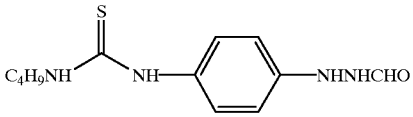
13
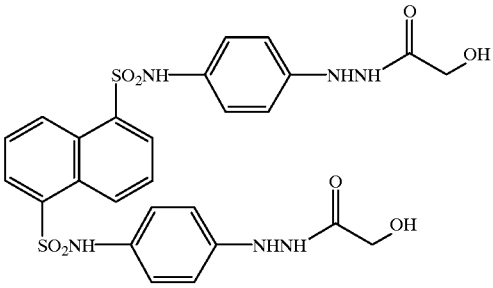
14
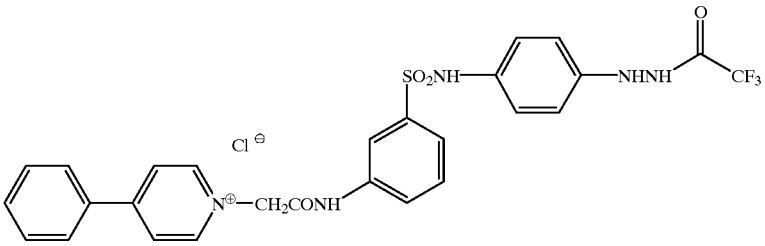
15
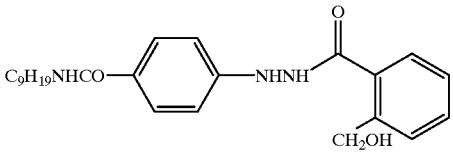
16
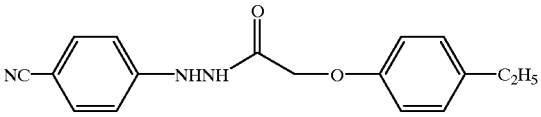
17
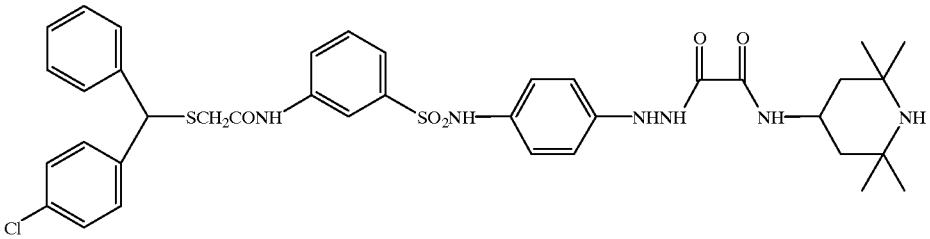

TABLE 3-continued
| | |
|---|---|
| 18 | 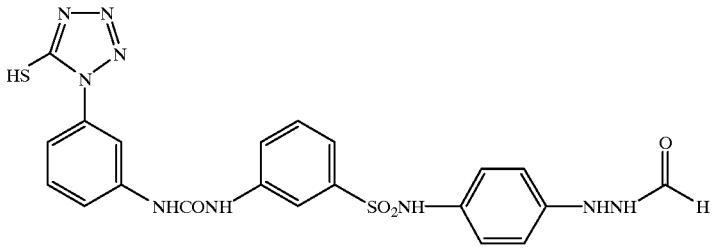 |
| 19 | 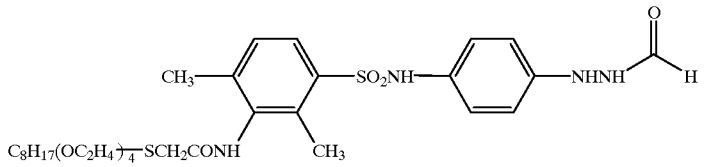 |
TABLE 4
| | |
|---|---|
| 20 | 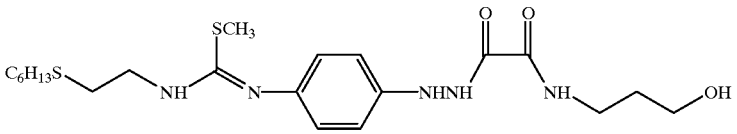 |
| 21 | 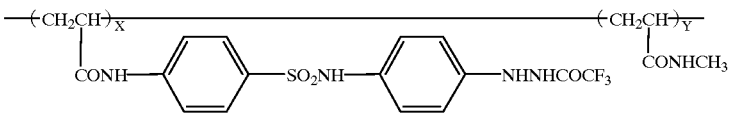 X:Y = 3:97 (molar ratio)<br>average molecular weight 100,000 |
| 22 | 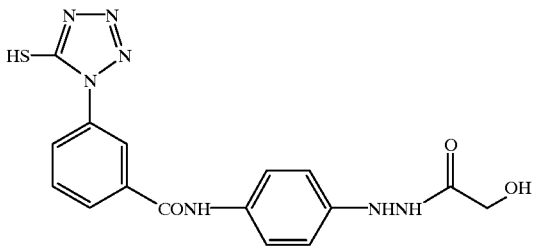 |
| 23 | 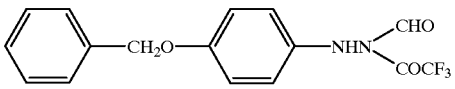 |
| 24 | 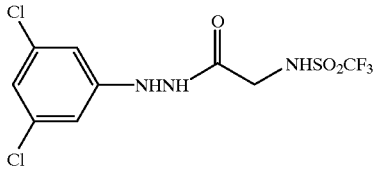 |

TABLE 4-continued

| | |
|---|---|
| 25 | 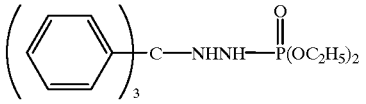 |

The hydrazine derivatives used in the present invention can be used with a single kind or two or more kinds of them. In addition to the above-described hydrazine derivatives, the hydrazine derivatives described below may also be preferably used in the present invention (depending on the case, the hydrazine derivatives may be used in combination). Furthermore, the hydrazine derivative for use in the present invention can be synthesized by various methods described in the following patent publications.

That is, exemplified are hydrazine derivatives described in, such as, JP-A-10-70672, JP-A-10-161270, JP-A-10-62898, JP-A-9-304870, JP-A-9-304871, JP-10-31282, U.S. Pat. No. 5,496,695, European Pat. No. 741320A.

The hydrazine based nucleation agent for use in the present invention may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydraline based nucleation agent for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, they may be used after dispersing the powder of the hydrazine derivative in an appropriate solvent such as water by a method known as a solid dispersion method, using a ball mill, colloid mill or ultrasonic wave.

The hydrazine nucleation agent for use in the present invention may be added to any layers on the image-forming layer side on the support, i.e., the image forming layer or other layers on that layer side; however, the hydrazine nucleation agent is preferably added to an image forming layer or a layer adjacent thereto.

The addition amount of the hydrazine derivatives for use in the present invention is preferably from $1\times10^{-6}$ to 1 mol, more preferably from $1\times10^{-5}$ to $1\times10^{-1}$ mol, most preferably from $2\times10^{-5}$ to $2\times10^{-2}$ mol, per mol of silver.

The heat developable image recording material of the present invention may contain a sensitizing dye. The sensitizing dye may be any one of those that can spectrally sensitize the halogenated silver halide particles at a desired wavelength region when they are adsorbed on the halogenated silver halide particles. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), Item 1831X (August, 1978, page 437) and also in the references as referred to in them. In particular, sensitizing dyes having a color sensitivity suitable for spectral characteristics of light sources of various laser imagers, scanners, image setters, process cameras and the like can advantageously be selected.

Exemplary dyes for spectral sensitization to so-called red light from light sources such as He-Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338.

Spectral sensitization as to the wavelength region of from 750 to 1,400 nm from semiconductor laser light sources can advantageously be obtained with various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroine nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus of these cyanine and merocyanine dyes, those having an imino group or a carboxyl group are particularly effective. The dye may be appropriately selected from known dyes described, for example, in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes particularly preferably used for the present invention are cyanine dyes having a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band have been disclosed in U.S. Pat. Nos. 5,510,236, 3,871,887 (Example 5), JP-A-2-96131, JP-A-59-48753 and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in *Research Disclosure*, Vol. 176, 17643, page 23, Item IV-J (December, 1978), JP-B-49-25500, JP-B-43-4933, JP-A-59-19032, JP-A-59-192242 and the like.

The sensitizing dyes may be used in combination of two or more of them for the present invention. The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

Furthermore, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultrasonic wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The amount of the sensitizing dye used in the present invention may be selected according to the performance such as sensitivity or fog; however, it is preferably from $10^{-6}$ to 1 mol, more preferably from $10^{-4}$ to $10^{-1}$ mol, per mol of silver halide in the photosensitive layer that is the image-forming layer.

The silver halide emulsion and/or organic silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Pat. No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The antifoggant which is preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

Although the antifoggant for use in the present invention may be added in any form of a solution, powder, solid microparticle dispersion materials and the like, the antifoggant is preferably added with solid microparticle dispersion materials in which water is used as a disperse medium in the case that the antifoggant is not water-soluble. The solid microparticle dispersion is performed using a known pulverization means (e.g., ball mill, vibrating ball mill, sand mill, colloid mill, jet mill, roller mill). At the time of solid microparticle dispersion, a dispersion aid may also be used.

Although not necessary for practicing the present invention, it is advantageous in some cases to add a mercury(II) salt as an antifoggant to the emulsion layer (the image-forming layer). Preferred mercury(II) salts for this purpose are mercury acetate and mercury bromide. The addition amount of mercury for use in the present invention is preferably from 1 nmol to 1 mmol, more preferably from 10 mmol to 100 $\mu$mol, per mol of silver coated.

The heat developable image recording material of the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-9-329863, JP-A-9-329864 and JP-A-9-281637. The benzoic acid compound for use in the present invention may be added to any site of the photosensitive material, but the layer to which the benzoic acid is added is preferably a layer on the surface having the image-forming layer such as a photosensitive layer, more preferably an organic silver salt-containing layer that is the image-forming layer. The benzoic acid compound for use in the present invention may be added at any step during the preparation of the coating solution. In the case of adding the benzoic acid compound to an organic silver salt-containing layer, it may be added at any stem from the preparation of the organic silver salt until the preparation of the coating solution, but is preferably added in the period after the preparation of the organic silver salt and immediately before the coating. The benzoic acid compound for use in the present invention may be added in any form of a powder, solution, microparticle dispersion and the like, or may be added as a solution containing a mixture of the benzoic acid compound with other additives such as a sensitizing dye, a reducing agent and a color toner. The benzoic acid compound for use in the present invention may be added in any amount; however, the addition amount thereof is preferably from 1 $\mu$mol to 2 mol, more preferably from 1 mmol to 0.5 mol, per mol of silver.

The heat developable image recording material of the present invention may contain a mercapto compound, a disulfide compound or a thione compound so as to control the development by inhibiting or accelerating the development, improve the spectral sensitization efficiency or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinolne and quinazolinone. The heteroaromatic ring may have a substituent selected from, for example, the group consisting of halogen (e.g., Br, Cl), hydroxy, amino, carboxy, alkyl (e.g., alkyl having one or more carbon atoms, preferably from 1 to 4 carbon atoms), and alkoxy (e.g., alkoxy having one or more carbon atoms, preferably from 1 to 4 carbon atoms). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, 2-[3-(9-carbazolyl)-propylimino]-3-(2-mercaptoethyl)benzothiazoline and the like. However, the present invention is by no means limited thereto.

The amount of the mercapto compound added is preferably from 0.0001 to 1.0 mol, more preferably from 0.001 to 0.3 mol, per mol of silver in an emulsion layer.

In the image forming layer of the invention, polyhydric alcohols (for example, glycerins and diols described in U.S. Pat. No. 2,960,404), fatty acid or ester as described in U.S. Pat. No. 2,588,765 and U.S. Pat. No. 3,121,060, silicone resin as described in British Patent No. 955,061, and the like, serving as a plasticizer or a lubricant can be used.

The pH of the image forming layer coating liquid of the invention is adjusted to be from 5.5 to 7.8, but an acid used during preparation preferably does not contain any halogen.

The heat developable image recording material of the invention is preferably of, so-called, a single side image recording material in which the material has an image forming layer containing at least one layer of silver halide emulsion on one side of the support and has a back layer on the other side.

With this invention, the back layer preferably has a maximum absorption in a prescribed range of about 0.3 or higher and 2.0 or lower. If the prescribed range is 750 to 1,400 nm, it is preferable that the optical density is equal to or greater than 0.005 and less than 0.5 in a range of 750 to 360 nm, more preferably, that it is an antihalation layer having an optical density equal to or greater than 0.001 and less than 0.3. When the prescribed range is 750 nm or less, the antihalation layer preferably has a maximum absorption equal to or greater than 0.3 less than 2.0 before image forming in the prescribed range and an optical density equal to or greater than 0.001 and less than 0.3 after image forming in the range of 750 to 360 nm. There is no special limitation to a method for lowering the optical density down to the above range after forming images, and exemplified are a method lowering dye density by eliminating colors from heating as described in Belgian Pat. No. 733,706, a method for lowering density by eliminating colors from light radiation as set forth in JP-A-54-17,833, and the like.

In the case when an antihalation dye is used in the present invention, the dye may be any compound so long as the compound has an objective absorption in the desired wavelength region, the absorption in the visible region can be sufficiently reduced after the processing, and the antihalation layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049.

The heat developable photographic emulsion used in this invention is structured of a single or more layers on the support. The structure of a single layer includes the organic silver salt, the silver halide, the developing agent, and the binder, and desired additional materials such as color adjuster, covering aid, and other aids. The structure of two layers includes the organic silver salt and the silver halide in the first emulsion layer (ordinarily a layer adjacent to the base), and sore other components should be included in the second layer or both layers. However, a two layer structure is conceivable in which the entire components are contained in the sole emulsion layer and in which a protection layer is contained. The structure of multicolor photosensitive heat developable photographic material may contain a component of those two layers for each color, and a single layer may contain all components as set forth in U.S. Pat. No. 4,708,928. In the case of multi-dye multicolor photosensitive heat developable photographic material, each emulsion layer may held generally in being distinctive from one another by using functional or non-functional barrier layers between the respective photosensitive layers as set forth in U.S. Pat. No. 4,460,681.

A backside resistive heating layer described in U.S. Pat. Nos. 4,460,681 and 4,374,921 may also be used in the photosensitive heat developable photographic image system.

A film hardening agent may be used for respective layers such as the photosensitive layer, the protection layer, and the back layer. As an example for the film hardening agent, exemplified are polyisocyanate groups as set forth in U.S. Pat. No. 4,281,060, JP-A-6-208,193, and the like, epoxy compound groups as set forth in U.S. Pat. No. 4,791,042 and the like, vinylsulfone based compound groups as set forth in JP-A-62-89048, and the like.

As a method for obtaining color images using the heat developable image recording materials of the invention, there is a method as set forth in JP-A-7-13,295, 10 page left column 43 line to 11 page left column line 40. As a stabilizer for color dying images, exemplified are British Patent No. 1,326,889, U.S. Pat. No. 3,432,300, U.S. Pat. No. 3,698,909, U.S. Pat. No. 3,574,627, U.S. Pat. No. 3,573,050, U.S. Pat. No. 3,764,337, and U.S. Pat. No. 4,042,394.

The heat developable photographic emulsion of the invention can be coated by various coating operations such as dipping coating, air knife coating, flow coating, and extrusion coating using a hopper as set forth in U.S. Pat. No. 2,681,294. Two or more layers, if desired, can be covered at the same time by a method as set forth in U.S. Pat. No. 2,761,791, and British Patent No. 837,095.

The heat developable photographic material of the invention may contain additional layers, for example, a dye reception layer for receiving movable dye images, non-transparent layer used when a reverse printing is made, a protection top coating layer, primer layers already known in the art of light heat photographic technology, and the like. The image recording material of the invention preferably can form images only with the single sheet of the image recording material, and it is preferable that the functional layers necessary for forming images such as an image receiving layer or the like are not in another material.

The heat developable image recording material of the present invention may be light exposed by any method but the light source for the exposure is preferably a laser ray. The laser ray for use in the present invention is preferably ore from a gas laser, YAG laser, dye laser, semiconductor laser or the like. The semiconductor laser and a second harmonic generation device may be used in combination.

The heat developable image recording material of the present invention has a low haze at the exposure and is liable to incur generation of interference fringes. For preventing the generation of interference fringes, a technique of entering a laser ray obliquely with respect to the image recording material disclosed in JP-A-5-113548 and a method of using a multimode laser disclosed in International Patent Publication WO95/31754 are known and these techniques are preferably used.

The heat developable image recording material of the present invention is preferably exposed such that the laser rays are overlapped and the scanning lines are not viewed as described in *SPIE*, Vol. 169, "Laser Printing", pages 116 to 128 (1979), JP-A-4-51043 and WO95/31754.

The heat developable image recording material of the present invention is developed by increasing temperature of the image recording material in which generally exposure is made imagewise. A preferred development temperature is from 80 to 250° C., more preferably from 100 to 140° C. The development time is preferably from 1 to 180 seconds, more preferably from 10 to 90 seconds.

As a method to prevent processing unevenness due to size deviation during the heat development from occurring caused by heating of the heat development image recording material of the invention, a method (so-called multistage heating method) is effective in which, after application of heats for five seconds or more at a temperature at 80° C. or higher but less than 115° C. (preferably 113° C. or less) so as not to produce any image, images are formed by heat development at a temperature of 110° C. or higher (preferably 130° C. or less).

As an embodiment of the heat developing apparatus of the invention, a preliminary heating section conveys the material with opposing rollers, and the heat developing processing section conveys the material on a side having the image forming layer of the heat developable image recording material by drive of rollers and a back surface on a side opposite to the above in sliding on a smooth surface.

As the heating means, in the preliminary heating section, respective heater rollers on either or both of the opposing rollers, or plate heaters above and/or below the preliminary heating section, can be used. In the heat developing processing section, heat rollers can be used for drive rollers on the side having the image forming layer, and plate heaters can be used above and/or below the heat developing processing section.

Control accuracy of the temperature is preferably within ±3° C. at respective portions, more preferably, within ±1° C., and further more preferably within ±0.5° C.

The linear velocity rate of the preliminary heating section to the heat developing processing section is equal to or less than 99.9% and equal to or greater than 95.0%, more preferably between 99.5% and 96%.

The average linear speed from insertion to delivery in the heat developing apparatus is preferably, 10 to 50 mm/sec, more preferably 15 to 30 mm/sec. Particularly, the linear velocity in the preliminary heating section and the heat developing processing section is preferably 10 to 40 mm/sec.

The rollers on the side having the image forming layer in the preliminary heating section and/or the heating developing processing section have at least a surface with a rubber hardness (JIS K 6301 spring type hardness tester) of 50 degrees or below, more preferably, 45 degrees or below and 20 degrees or above, and further more preferably, a roller coated with a rubber having a thickness of 0.5 mm or higher, more preferably equal to or higher than 1 mm and equal to or lower than 10 mm. The material of the rubber is preferably of a silicone rubber.

The clearance between the smooth surface of the heat developing processing section of the heat developing apparatus and the surface of the drive roller in contact with or opposing to the smooth surface is preferably 0 to 2 mm, more preferably, 0.0 mm to 1.0 mm. If the clearance is less 0 mm, conveyance failures of the heat developable image recording material tend to occur, and if the clearance exceeds 2 mm, the temperature control accuracy of the heat developing processing section becomes worse.

The smooth surface is a surface on a side in contact with the back surface of the heat developable image recording material during conveyance of the heat developable image recording material. Where the smooth surface is formed of a material changing the state of the smooth surface between during conveyance and during non-conveyance of the heat developable image recording material, the surface includes such a material. For example, in the smooth surface in which a nor-woven is attached to the surface portion, the fibril tips of the non-woven constitute the smooth surface. This is the sane to the surface of the drive roller.

The nip force of the first roller pair in a slowly cooling section (C in FIG. 1) is, as force to convey the heat developable image recording material, preferably 5 to 50 g/cm, more preferably 15 to 30 g/cm.

FIG. 1 shows a structural example of a heat developing machine used for heat developing process of the heat developable photosensitive material of the invention. FIG. 1 shows a side view of the heat developing apparatus. The heat developing apparatus shown in FIG. 1 includes a feeding roller pair 11 (lower roller is the heating roller) for feeding the heat developable image recording material 10 in a plane manner in correcting and preliminary heating the material 10 into a heating section and another feeding roller pair 12 for feeding the heat developable image recording material 10 in a plane manner in correcting the material 10 after heat development. The heat developable image recording material 10 is subject to heat development during feeding from the feeding roller pair 11 to the feeding roller pair 12. A conveying means for conveying the heat developable image recording material 10 during the heat development has a plurality of rollers 13 on a side with which a surface having the image forming layer is in contact and a smooth surface 14 to which a nonwoven fabric or the like is adhered on a side where the back surface in opposition to the above side is in contact. The heat developable image recording material 10 is conveyed by drive of the plural rollers 13 in contact with the surface having the image forming layer where the back surface slides on the smooth surface 14. As a heating means, heaters 15 are installed above the rollers 13 and below the smooth surface 14 so that both sides of the heat developable image recording material 10 are heated. As a heating means in this situation, panel heaters and the like are exemplified. The clearance between the rollers 13 and the smooth surface 14 may vary depending on the member of the smooth surface but is adjusted to a certain clearance capable of feeding the heat developable image recording material 10. It is preferably 0 to 2 mm, more preferably 0.0 to 1.0 mm.

The material of the surface of each roller 13 and the member of the smooth surface 14 can be any material as far as durable at a high temperature and not raising any problem to feed the heat developable image recording material 10. The material of the roller surface is preferably silicone rubber, and the member of the smooth surface is preferably of a nonwoven fabric made of a polyphenylenesulfate (PPS) or polytetrafluoroethylene. As a heating means, plural heaters are used, and each preferably is controlled to set freely its heating temperature.

Although the heating section is constituted of the preliminary heating section A having the feeding roller pair 11 and a heat developing processing section B having the heaters 15, the preliminary heating section A located on an upstream side of the heat developable processing section B is preferably set at a temperature lower than the heat developing temperature (e.g., about 10 to 50° C. lower), and more preferably, at a temperature higher than the glass transition temperature (Tg) of the support of the heat developable image recording material 10 as not to create beko and unevenness in development.

A guide plate 16 is disposed on a downstream side of the heat developing processing section B, and a slowly cooling section C having the conveyance roller pair 12 and the guide plate 16 is also disposed. The guide plate 16 is preferably made of a material having a low heat conducting rate, and cooling preferably is done gradually. The cooling rate is preferably 0.5 to 10° C./sec.

The nip force of the feeding roller pair 12 is preferably 5 to 50 g/cm as force for conveying the heat developable image recording material, and more preferably 15 to 30 g/cm.

With this invention, when the image recording material is subject to heat developing processing, the material is exposed to a high temperature of 110° C. or higher, so that a part of the components contained in the image recording material, and a part of the dissolved components due to heat development may be evaporated. Those vaporized components may have various adverse effects, such as causing development unevenness, corroding the structural members of the heat developing apparatus, serving as deposited foreign objects at low temperature places to cause deformation of images, and clinging to images and becoming dirty. To eliminate those effects, an art has been known in which a filter is mounted to the heat developing apparatus and in which the air flow in the heat developing apparatus is adjusted in an optimum way. Those can be used in combination. The following is an example.

In WO 95/30933, WO97/21150, Japanese Unexamined Patent Publication for PCT case 10-500496, a filter cartridge having coupled absorbing particles, a first opening for introducing vaporized components, and a second opening for exhausting the components, used for a heating apparatus for heating the film in contact with the film is described. In WO 96/12213, Japanese Unexamined Patent Publication for PCT case 10-507403, a filter is described in which a thermal conductive condensing collector and a gas absorption fine particle filter are combined.

In U.S. Pat. No. 4,518,845, JP-B-3-54331, a structure is described in having an apparatus removing steam from the film, a pressing apparatus for pressing the film to a heat conducting member, and an apparatus for heating the heat conducting member. In WO98/27458, components increasing fogs vaporized from the film are removed from the film surface.

The apparatus is illustrated according to the illustrated example, but the heat developing apparatus is not Limited to this, and the heat developing apparatus used in this invention can have various structures.

The present invention will be specifically explained with reference to following Examples. Materials, use amounts, ratios, processing contents, manipulations and the like shown in the following examples can be optionally changed so long as such change does not depart from the spirit of the present invention. Therefore, the scope of the present invention is not limited to the following examples.

EXAMPLE 1

Preparation of Silver Halide Emulsion (Emulsion A)

Into 700 ml of water, 11 g of phthalized gelatin, 30 mg of potassium bromide and 10 mg of sodium benzene thiosulfonate were dissolved, and after adjusting the pH to 5.0 at a temperature of 40° C., 159 ml of an aqueous solution containing 18.6 g of silver nitrate and an aqueous solution containing 1 mol/l of potassium bromide, $5\times10^{-6}$ mol/l of $(NH_4)_2RhC_{15}(H_2O)$, and $2\times10^{-5}$ mol/l of $K_3IrC_{16}$ were added by the control double jet method over 6 minutes and 30 seconds while keeping the pAg at 7.7.

Subsequently, 476 ml of an aqueous solution containing 55.5 g of silver nitrate and an aqueous halogen salt solution containing 1 mol/l of potassium bromide and $2\times10^{-5}$ mol/l of $K_3IrC_{16}$ were added by the control double jet method over 28 minutes and 30 seconds while keeping the pAg at 7.7. Thereafter, the pH was lowered to cause coagulation precipitation and then 0.17 g of Compound A and 23.7 g of deionized gelatin (calcium containing amount is 20 ppm) are adjusted to the pAg at 8.0 with the pH 59. The obtained particles had a mean particle size of 0.08 micron, a coefficient of variation of the projected area of 9%, and a (100) face ratio of 90% and were cubic particles.

The silver halide particles thus obtained was warmed to 60° C. and added with sodium benzene thiosulfonate in an amount of 76 micron mol per mol of silver, and after 3 minutes, sodium tiosulfate of 154 microns was added, ripened for 100, it was cooled to 40° C. after adding 4-hydroxy-6-methyl-1,3,3a,7-tetrazaindene of $5\times10^{-4}$ mol.

Subsequently, it was kept at 40° C., added with $12.8\times10^{-4}$ mol of the below sensitizing dye A and the compound B of $64\times10^{-3}$ mol in stirring those. After rapidly cooling it after 20 minutes, the preparation of silver halide emulsion A was finished.

adjusted to be 500 g as the whole weight and then preliminarily dispersed at a homo mixer.

Then, the original liquid already preliminarily dispersed was treated three times where the pressure of the dispersing machine (goods name: Microfluidizer M-110S-EH, Microfluidics International Corporation made, with G10Z interaction chamber) is adjusted to 1750 kg/m$^2$ and handled three times to obtain the organic silver salt dispersion A. The organic acid silver salt particles contained in the organic acid silver salt dispersion obtained as described above were acicular grains having an average minor axis length of 0.04 $\mu$m, an average major axis length of 0.8 $\mu$m and a variation coefficient of 30%. The measure the particle size is made by Master Sizer X made of Malvern Instruments Ltd. The cooling control is made by attaching the meander type heat exchangers in the front of and at the rear of the interaction chamber, and the desired dispersion temperature was set by adjusting the temperature of the coolant. Thus, he organic silver salt A having 85 mol % of behenic acid containing rare was prepared.

Preparation of Solid Micro-particle Dispersion of 1,1-bis(2-hydroxy-3,5-dimethylphenyl)-3,5,5-trimethylhexane To 20 g of 1,1-bis(2-hydroxy-3,5-dimethylphenyl)-3,5,5-trimethylhexane and 3.0 g of MP-203 of Kuray Co. made, 77

Sensitizing dye A

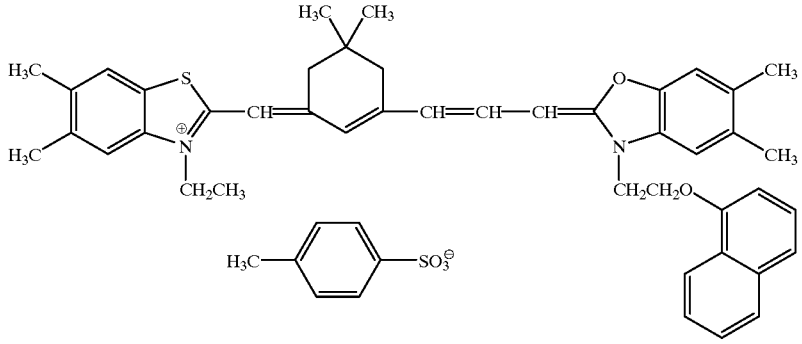

Compound A

Compound B

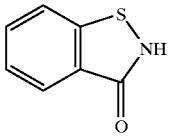

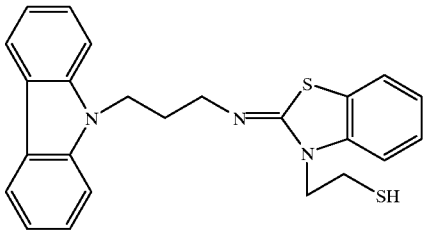

Preparation of Organic Silver Salt Dispersion (Organic Silver Salt A)

123 ml of 1N aqueous NaOH solution was added to 6.1 g of arachic acid, 37.6 g of behenic acid, and 70 ml of tert-butanol in 700 ml of distilled water with stirring at 75° C. allowed to react for one hour, and cooled to 65° C. Then, 112.5 ml of an aqueous solution containing 22 g of silver nitrate was added over 45 seconds to the reaction mixture, which was then left as it was for 5 minutes to be cooled to 30° C. Thereafter, the solid content was separated by suction filtration, and the solid content was washed with water until the conductivity of the filtered water became 30 $\mu$S/cm. The solid content obtained as described above was handled as a wet cake without being dried. Polyvinyl alcohol (goods name: PVA-217) of 5 g and water are added to the wet cake corresponding to 100 g of dried solid portion, and it was g of water was added and sufficiently stirred to form a slurry. The slurry was left for three hours. Subsequently, the slurry was introduced into a vessel together with 360 g of zirconia beads having an average particle size of 0.5 mm, and dispersed in a dispersing machine (1/4G Sand Grinder Mill, Imex Co., Ltd.) for 3 hours to prepare a reducing agent solid fine particle dispersion. The particle size was 0.3 micron or larger and 1.0 micron or less with 80% by weight of particles.

Preparation of Solid Fine Particle Dispersion of Tribromomethylphenylsulfone

To 30 g of tribromomethylphenyisulfone, 0.5 g of hydroxypropylmethyl cellulose, and 0.5 g of a compound C, and 88.5 g of water were added and sufficiently stirred to form a slurry, which was left for three hours. Subsequently, in substantially the same manner as the reducing agent solid fine particle dispersion, a solid micro-particle dispersion for prevention agent was prepared. The particle size was 0.3 micron or larger and 1.0 micron or less with 80% by weight of particles.

Preparation of Image Forming Layer Coating Liquid

To silver 1 mol of the thus produced organic silver salt fine particle dispersant, the following binders, materials, and a silver halide emulsion A are added, and adding water, a coating liquid was formed. The coating liquid had a pH of 7.5 to 7.7.

| | |
|---|---|
| Binder; LACSTAR, 3307B as a solid portion, (Dainippon Ink & Chemicals, Inc., SBR latex, glass transition temperature Tg = 17° C.) | 406 g |
| 1,1-bis(2-hydroxy-3,5-dimethylphenyl)-3,5,5-trimethylhexane as a solid portion, | 119 g |
| tribromomethylphenylsulfone as a solid portion, | 21.6 g |
| sodium benzene thiosulfonate | 0.44 g |
| benzotriazole | 1.25 g |
| polyvinyl alcohol (MP-203 (Kuraray Co., Ltd)) | 20 g |
| cso-propylephthalazin | 0.10 mol |
| orth-sodium dihydrogen phosphate | 0.13 g |
| development suppressor A | 9.38 g |
| nucleation agent C-62 | 0.9 g |
| dye A | |
| coating amount such that the optical density of 783 nonmagnetic is 0.3 | |
| silver halide emuision A | 0.05 mol as Ag amount |

Compound C

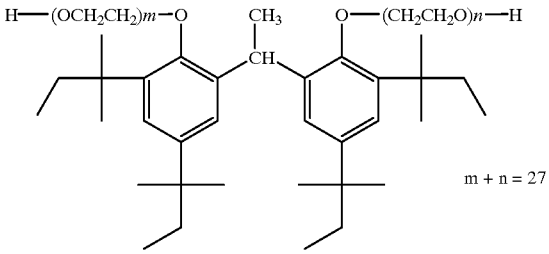

Compound D

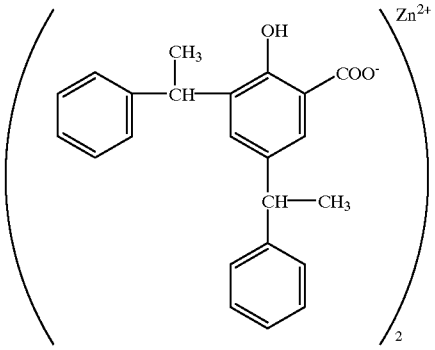

-continued

Dye A

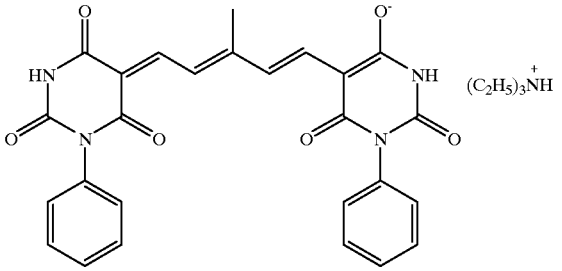

C-62

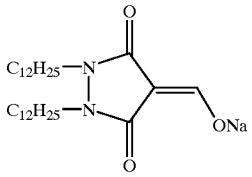

Preparation of Coating Liquid for Protection Layer A $H_2O$ of 262 g was added to 500 g of a 40 wt % polymer latex (methyl methacrylate/styrene/2-ethylhexyl acrylate/2-hydroxyethyl methacrylate/acrylic acid=59/9/26/5/1, copolymer; Tg; 47° C.). Subsequently added were, as a film forming aiding agent, benzyl alcohol of 14 g, following compound No. 2 of 2.5 g, Cellosol 524 (Chukyo Oil and Fat Co., Ltd.) of 3.6 g, following compound No. 3 of 12 g, following compound No. 4 of 1 g, following compound No. 5 of 2 g, following compound No. 6 of 7.5 g, and poly methyl methacrylate particles of 3.4 g having an average particle size of 3 microns as a matting agent. Furthermore, $H_2O$ was added to the material to form the material at 1000 g, thereby preparing a coating liquid of viscosity 5 cp (at 25° C.) and pH 3.4 (at 25° C.).

Compound 2

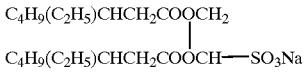

Compound 3

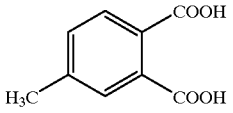

Compound 4

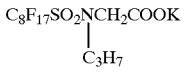

Compound 5

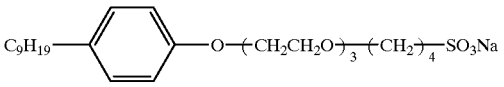

Compound 6

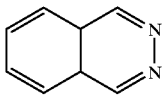

Preparation of Coating Liquid for Comparative Protection Layer B $H_2O$ of 1800 g was added to powder 200 g of an alkali processed gelatin ($Ca^{++}$ contained amount 0.06 ppm, jelly rigidity 260 g), and after solved by increasing the temperature to 50° C., the temperature was decreased to 40° C. Then, in substantially the same way as the polymer latex protection layer coating liquid, Cellosol 524, compound No. 2 to No. 6, and the matting agent were added, and $H_2O$ was added to obtain 3000 g of liquid, thereby preparing a coating liquid of viscosity 15 cp (at 40° C.) and pH 4.0.

Production of PET Support Having Back Layer/Undercoating Layer (1) Support

Using a terephthalic acid and an ethylene glycol, according to a normal method, a PET of IV (intrinsic viscosity)=66 (measured at 25° C. in phenol/tetrachloroethane=6/4 (ratio by weight)) was obtained. After this was made if into pellets, they are dried for four hours at 130° C. After extruded from a T-shape die after melted at 300° C., the material was rapidly cooled, and non-drawn film was produced with a thickness such that the film thickness after getting thermal stability was 120 microns.

This film was longitudinally drawn 3.3 times using rollers having different peripheral speeds from one another and transversely drawn 4.5 times using a center. At that time, the temperatures are 110° C. and 130° C., respectively. Then, 4% relaxation was made in the transverse direction at the temperature of 240° C. after thermally stabilizing the film at the same temperature for 20 seconds. Subsequently, the chuck of the center was released, the both edges of the film were knurled, and the film was rolled at 4.8 kg/cm$^2$. Thus, a roll was obtained with a width of 2.4 m, a length of 3,500 m, and a thickness of 120 microns.

(2) Undercoating Layer (a) Polymer Latex V-5

It was a latex of a core and shell type having a core portion of 90% by weight and a shell portion of 10% by weight. The core portion was made of vinylidene chloride/methylacrylate/methylmethacrylate/acrylonitrile/acrylic acid=93/3/3/0.9/0.1 (% by weight). The shell portion was made of vinylidene chloride/methylacrylate/methylmethacrylate/acrylonitrile/acrylic acid=88/3/3/3/3 (% by weight). Weight average molecular weight is 38000.

| | |
|---|---|
| Solid portion amount | 3.0 g/m$^2$ |
| 2,4-dichloro-6-hydroxy-s-triazine | 23 mg/m$^2$ |
| Matting agent (polystyrene, average diameter; 2.4 $\mu$m) | 1.5 mg/m$^2$ |

(3) Undercoat Layer (b)

| | |
|---|---|
| Alkali Processed gelatin ($Ca^{++}$ contained amount; 30 ppm, jelly strength; 230 g) | 83 mg/m$^2$ |
| Compound A | 1 mg/m$^2$ |
| Compound H | 2 mg/m$^2$ |
| Methyl cellulose | 4 mg/m$^2$ |
| Compound I | 3 mg/m$^2$ |

(4) Electroconductive Layer (Surface Resistivity $10^5$ Ω at 25° C., 25% RH)

| | |
|---|---|
| Julimer ET-410 (Nihon Junyaku Co., Ltd.) | 96 mg/m$^2$ |
| Gelatin | 72 mg/m$^2$ |
| Compound A | 0.2 mg/m$^2$ |
| Polyoxyethylenephenylether | 5 mg/m$^2$ |
| Sumitex Resin M-3 (water-soluble melamine compound, Sumitomo Chemical Industry (K.K.) made) | 18 mg/m$^2$ |
| Dye A (optical density of 783 nm ≧ 1.0) | 25 mg/m$^2$ |
| $SnO_2$/Sb (weight ratio; 9/1, needle shaped fine particles, major/minor axis = 20 to 30, Isihara Sangyo K.K. made) | 230 mg/m$^2$ |
| Matting agent (Polymethyl methacrylate, average particle size; 2.4 $\mu$m) | 0.5 mg/m$^2$ |
| Compound J | 2 mg/m$^2$ |

(5) Back Layer (1)

| | |
|---|---|
| Julimer ET-410 (Nihon Junyaku Co., Ltd.) | 95 mg/m$^2$ |
| Compound J | 2 mg/m$^2$ |
| Sumitex Resin M-3 (water-soluble melamine compound, Sumitomo Chemical Industry (K.K.) made) | 3 mg/m$^2$ |
| Carnauba wax (Chukyo Oil and Fat Co., Ltd. Cellosol 524) | 3 mg/m$^2$ |

(6) Back Layer (2) Having the Same Prescription as the Undercoating Layer (a).

(7) Back Layer (3)

| | |
|---|---|
| Polymer latex (3) (Tg ≈ 45° C.) (methyl methacrylate/styrene/2-ethylhexyl acrylate/2-hydroxyethyl methacrylate/acrylic acid = 59/9/26/5/1 (wt %, copolymer)) | 1000 mg/m$^2$ |
| Lubricant A | 21 mg/m$^2$ |
| Sumitex Resin M-3 (water-soluble melamine compound, Sumitomo Chemical Industry (K.K.) made) | 218 mg/m$^2$ |
| Surfactant; | |
| Compound example F-5 | 8 mg/m$^2$ |
| Compound example F-3 | 7 mg/m$^2$ |
| Matting agent (a copolymer of methylmethacrylate/acrylic acid = 97/3 (% by weight), average particle size; 5 $\mu$m) | 11 mg/m$^2$ |

Compound H

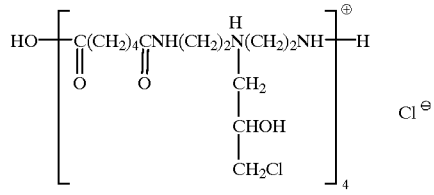

Compound I $C_{12}H_{25}O(CH_2CH_2O)_{10}H$

Compound J

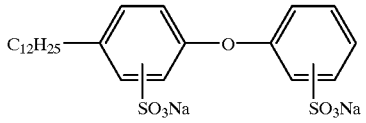

Lubricant A $C_{16}H_{33}OSO_3Na$

The undercoating layer (a) and the undercoating layer (b) were coated sequentially on one side of the support, and those were dried for four minutes at 180° C. Then, a conductive layer and back layers (1) to (3) were coated sequentially on the opposite side to the side where the undercoating layer (a) and the undercoating layer (b) were coated, and a PET support was produced with back/undercoating layers upon drying at 180° C. for 30 seconds.

Thus formed PT support with the back/undercoating layers was placed in thermal treatment zone extending in a whole length of 30 m set at a temperature of 150° C., and conveyed by its weight at a tension of 1.4 kg/cm$^2$ and feeding speed of 20 m/min. Thereafter, it passed a zone of 40° C. for 15 seconds, and was wound by winding tension of 10 kg/cm$^2$.

Conveyance Heating Processing

Heating Processing

In a heating processing zone having whole length of 200 m in which a PET support with a back layer and an undercoating layer was set at the temperature and tension described in Table 5, the image recording material was conveyed at a conveyance rate of 20 m/min.

Post-heating Processing

Subsequently to the thermal processing, the image recording material was wound up after post-heating processing with temperature and tension as described in Table 5. At that time, winding tension was 10 kg/cm$^2$.

Table 5 shows size deviation rate (%) of the support sought according to the heat developable image recording material (specimen) as described below and whether beko occurs, together.

TABLE 5

| Support No. | Heat processing: Tension (kg/cm$^2$) | Heat processing: Temp. (° C.) | Post-heat processing: Time (Sec.) | Post-heat processing: Temp. (° C.) | Size deviation rate (%) at 120° C. for 30 sec. after heat processing: MD direction | Size deviation rate (%) at 120° C. for 30 sec. after heat processing: TD direction | Beko occurance on film after heat development |
|---|---|---|---|---|---|---|---|
| 1 | No heat processing | | No heat processing | | −0.150 | 0.800 | x |
| 2 | 3 | 130 | 15 | 40 | −0.005 | 0.015 | ○ |
| 3 | 5 | 130 | 15 | 40 | −0.008 | 0.019 | ○ |
| 4 | 7 | 130 | 15 | 40 | −0.010 | 0.025 | ○ |
| 5 | 10 | 130 | 15 | 40 | −0.025 | 0.035 | ○ |
| 6 | 3 | 160 | 15 | 40 | −0.005 | 0.014 | ○ |

TABLE 5-continued

| Support No. | Heat processing: Tension (kg/cm$^2$) | Heat processing: Temp. (° C.) | Post-heat processing: Time (Sec.) | Post-heat processing: Temp. (° C.) | Size deviation rate (%) at 120° C. for 30 sec. after heat processing: MD direction | Size deviation rate (%) at 120° C. for 30 sec. after heat processing: TD direction | Beko occurance on film after heat development |
|---|---|---|---|---|---|---|---|
| 7 | 3 | 200 | 15 | 40 | −0.003 | 0.010 | ○ |
| 8 | 3 | 220 | 15 | 40 | −0.030 | 0.025 | ○ |

○: nonoccur
x: occur

Preparation of the Heat Developable Image Recording Material (Specimen)

On the side of the undercoating layer of the PET support where the electroconductive layer and the back layers (1) to (3) and the undercoating layers (a), (b) were coated, the above image forming layer and the protection layers thereon were coated in a multilayer fashion at the sane time as to make the coated sliver amount 1.6 g/m$^2$ and to make the coating amounts of the polymer latex solid portion and gelatin solid portion of the protection layer 2.5 g/m$^2$, respectively, and dried at 70° C. drying temperature for three minutes, thereby producing specimens. The results were shown in Tables 6, 7.

1) Occurrence test method of beko, side ripple, and scar after heat development

Using a heat developing apparatus having a conveyance section as shown in FIG. 1 and a heat developing apparatus as disclosed in specification in WO97-13181, heat developing processing was made, and whether beko, side ripple, and scar occur or not was observed by naked eyes. It is to be noted that the heat developing apparatus as disclosed in specification in WO97-13181 is that a heating transfer is made where a roller of a small diameter is closely disposed on a heating drum to sandwich the material with the drum and the small diameter roller (heat development condition 120° C., 20 sec.).

The heat development condition using the heat developing apparatus as shown in FIG. 1 is as follows:

(1) Preliminary heating section A (heating roller's temperatures where the feeding roller pairs 11 are set as No. 1 to No. 6 from the upstream side.)

| | | |
|---|---|---|
| Feeding roller pairs 11 | No. 1 | 75° C. |
| | No. 2 | 90° C. |
| | No. 3 | 105° C. |
| | No. 4 | 117° C. |
| | No. 5 | 121° C. |
| | No. 6 | 121° C. |

(Heating time is 21 seconds in toral.)

(2) Heat developing processing section B (plate heaters' temperatures located on the upper side and lower side where the heaters 15 are set as No. 1 to No. 3 from the upstream side.)

| | |
|---|---|
| Heater 15 | No. 1 Upper/Lower = 122° C./122° C.<br>No. 2 Upper/Lower = 122° C./122° C.<br>No. 3 Upper/Lower = 122° C./122° C. |

(Heating time is 18 seconds in toral.)

Heat resisting fabrics of the smooth surface 14 were tested in a comparative way using two kinds made of Nomex aramid fiber and polytetrafluoroethylene fiber, respectively. The thickness of the heat resisting fabrics was 10 mm.

| | |
|---|---|
| (3) Slowly cooling section C | |
| Feeding roller pair 12 (temperature of the heat roller) | 112° C. |
| Cooling speed | 120° C./min |
| (4) Line speed | 20 mm/sec. |

2) Measuring method of size deviation rate according to the heat developing process Two holes of 8 mm diameter were opened with space of 200 mm to specimens (size 5 cm×25 cm) before processing whose entire surface was exposed to light, and the interval of the two holes were measured accurately using pin gauge having accuracy of 1/1000. The size at that time was X (mm unit). Then, using a heat developing apparatus having a conveyance section as shown in FIG. 1, a heat developing processing was made under a development condition of 120° C., 30 sec., and 10 minutes later, the size was measured with the pin gauge. The size at that time was Y (mm unit).

Size deviation rate (%)=[(Y-X)/200]×100 It was evaluated using the above formula.

TABLE 7

| Processing | Specimen No. | Support No. | Protection layer and its binder on the side having the image forming layer | Heat developing apparatus disclosed in WO97-13181 Beko | Mimiwakame | Scar |
|---|---|---|---|---|---|---|
| II-1* | 1* | 1 | B(gelatin) | X | X | X |
| II-2* | 2* | 1 | A(polymer latex) | ○ | X | X |
| II-3* | 3* | 2 | B(gelatin) | X | X | X |
| II-4* | 4 | 2 | A(polymer latex) | ○ | X | X |
| II-5* | 5* | 3 | B(gelatin) | X | X | X |
| II-6* | 6 | 3 | A(polymer latex) | ○ | X | X |
| II-7* | 7* | 4 | B(gelatin) | X | X | X |
| II-8* | 8 | 4 | A(polymer latex) | ○ | X | X |
| II-9* | 9* | 5 | B(gelatin) | X | X | X |
| II-10* | 10* | 5 | A(polymer latex) | ○ | X | X |
| II-11* | 11* | 6 | B(gelatin) | X | X | X |
| II-12* | 12 | 6 | A(polymer latex) | ○ | X | X |
| II-13* | 13* | 7 | B(gelatin) | X | X | X |
| II-14* | 14 | 7 | A(polymer latex) | ○ | X | X |
| II-15* | 15* | 8 | B(gelatin) | X | X | X |
| II-16* | 16* | 8 | A(polymer latex) | ○ | X | X |

*: Comparative example
○: nonoccur
X: occur

As apparent from, Tables 6,7, the heat developing method using the specimens according to the invention showed no occurrence of beko, side ripple, and scar, and where the support subject to the heat processing according to the invention is used, the size deviation will become very small in the heat developing processing.

TABLE 6

| Processing | Specimen No. | Support No. | Protection layer and its binder on the side having the image forming layer | Heat resistant fabric used in FIG. 1: Teflon Beko | Teflon Mimiwakame | Teflon Scar | Nomex Beko | Nomex Mimiwakame | Nomex Scar | Size deviation rate (%) MD | TD |
|---|---|---|---|---|---|---|---|---|---|---|---|
| 1-1* | 1* | 1 | B(gelatin) | X | X | ○ | X | X | Δ | −0.165 | 0.750 |
| 1-2* | 2* | 1 | A(polymer latex) | ○ | ○ | ○ | ○ | ○ | Δ | −0.150 | 0.750 |
| 1-3* | 3* | 2 | B(gelatin) | X | X | ○ | X | X | Δ | −0.010 | 0.007 |
| 1-4 | 4 | 2 | A(polymer latex) | ○ | ○ | ○ | ○ | ○ | Δ | −0.008 | 0.015 |
| 1-5* | 5* | 3 | B(gelatin) | X | X | ○ | X | X | Δ | −0.015 | 0.010 |
| 1-6 | 6 | 3 | A(polymer latex) | ○ | ○ | ○ | ○ | ○ | Δ | −0.008 | 0.019 |
| 1-7* | 7* | 4 | B(gelatin) | X | X | ○ | X | X | Δ | −0.020 | 0.020 |
| 1-8 | 8 | 4 | A(polymer latex) | ○ | ○ | ○ | ○ | ○ | Δ | −0.010 | 0.025 |
| 1-9* | 9* | 5 | B(gelatin) | X | X | ○ | X | X | Δ | −0.034 | 0.029 |
| 1-10* | 10* | 5 | A(polymer latex) | ○ | ○ | ○ | ○ | ○ | Δ | −0.025 | 0.033 |
| 1-11* | 11* | 6 | B(gelatin) | X | X | ○ | X | X | Δ | −0.017 | 0.007 |
| 1-12 | 12 | 6 | A(polymer latex) | ○ | ○ | ○ | ○ | ○ | Δ | −0.005 | 0.014 |
| 1-13* | 13* | 7 | B(gelatin) | X | X | ○ | X | X | Δ | −0.014 | 0.002 |
| 1-14 | 14 | 7 | A(polymer latex) | ○ | ○ | ○ | ○ | ○ | Δ | −0.003 | 0.010 |
| 1-15* | 15* | 8 | B(gelatin) | X | X | ○ | X | X | Δ | −0.039 | 0.018 |
| 1-16* | 16* | 8 | A(polymer latex) | ○ | ○ | ○ | ○ | ○ | Δ | −0.030 | 0.024 |

MD: Machine Direction
TD: Transverse Direction
*: Comparative example
○: nonoccur
Δ: slightly occur
X: occur

EXAMPLE 2

Preparation of Coating Liquid for Lower Protection Layer

Water, 25 g was added to 150 g of a polymer latex made of methyl methacrylate/styrene/2-ethylhexyl acrylate/2-hydroxyethyl methacrylate/acrylic acid=59/9/26/5 (wt %) (solid portion concentration 30% by weight; as a film forming aid agent, compound E of 15% by weight with respect to a polymer solid portion, I/O value=0.49). Subsequently, adding 1.3 g of a water solution of 5% by weight of compound F, 50 g of a water solution of polyvinyl alcohol (PVA-235 made by Kurarey Co.) as a viscosity increasing agent, and 0.1 g of a matting agent (polystyrene particles having average particle size of 7 $\mu$m) to the liquid, a coating liquid was prepared. The coating liquid had a pH of 6.5 to 7.0.

Preparation of Coating Liquid for Upper Protection Layer

To a polymer latex made of methyl methacrylate/butyl acrylate=73/27 (wt %) (solid portion concentration 30% by weight; as a film forming aid agent, compound E of 15% by weight with respect to a polymer solid portion, I/O value=0.55) of 150 g, 2.5 g of water solution of 5% by weight of compound F, 2.5 g of water disperse liquid of 30 wt % of carnauba wax (Chukyo Oil and Fat Co., Ltd. Cellosol 524), 46 g of a water solution of 5% by weight of polyvinyl alcohol (PVA-235 made by Kurarey) as a viscosity increasing agent, and 0.3 g of a matting agent (polystyrene particles having average particle size of 7 $\mu$m) were added, and further, 25 g of a water solution of 10% by weight of compound G was added to prepare a coating liquid. The pH of the coating liquid was 2.5 to 3.0.

Compound E

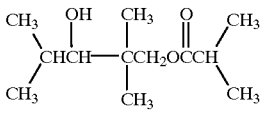

Compound F

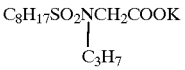

Compound G

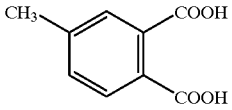

Production of PET Support With Back/undercoating Layer

A PET support with back/undercoating layer was produced according to the following steps using the undercoating layer (a), the undercoating layer (b), conducting layer, back layers (1), (2), (3) in the same way as Example 1. The lubricant A in the back layer (3) was used at 37 mg/m$^2$.

The undercoating layer (a) and the undercoating layer (b) were coated sequentially on one side of the support, and those were dried for four minutes at 180° C. Then, a conductive layer and back layers (1) to (3) were coated sequentially on the opposite side to the side where the undercoating layer (a) and the undercoating layer (b) were coated, and a PET support was produced with back/undercoating layers upon drying at 180° C. for 30 seconds.

Thus formed PET support with the back/undercoating layers was placed in thermal treatment zone extending in a whole length of 30 m set at a temperature of 150° C., and conveyed by its weight at a tension of 1.4 kg/cm$^2$ and feeding speed of 20 m/min. Thereafter, it passed a zone of 40° C. for 15 seconds, and was wound by winding tension of 10 kg/cm$^2$.

Preparation of the Heat Developable Image Recording Material

On the side of the undercoating layer of the PET support where the electroconductive layer and the back layers (1) to (3) and the undercoating layers (a), (b) were coated, the above image forming layer and the lower and upper protection layers thereon were coated in a multilayer fashion at the same time as to make the coated sliver amount 1.6 g/m$^2$ and to make the coating amount of the polymer latex solid portion of the protection layer 1.5 g/m$^2$ at the lower layer and 2.5 g/m$^2$ at the upper layer, and dried at 70° C. drying temperature for three minutes, thereby producing a specimen.

Beck smoothness of the produced specimen was 1000 seconds on the surface having the image forming layer and 650 seconds on the surface opposite to the above surface, and the surface specific resistance of the conductive layer is $4\times10^9$ Ω under the condition 25° C., 20% RH.

The obtained specimen was evaluated in the following manner.

(1) Friction Coefficient a) Friction coefficient between the heat developing processing roller and the surface having image forming layer of the image recording material Friction resistance force (Fe) at 120° C. where the surface having the image forming layer of the image recording material is moved at 19 mm/sec speed as carrying a 20 g load on a member having 2 cm width and the surface material and the outer diameter the same as the roller surface was measured, and friction coefficient was sought according to the following formula.

$$\text{Friction coefficient } (\mu e) = \text{Fe (g)}/20 \text{ (g)}$$

b) Friction coefficient between the heat developing processing section smooth surface and the back surface of the image recording material Friction resistance force (Fb) where the back surface of the image recording material is moved as carrying a 40 g load on a smooth surface member (non-woven fabric) having a size of 2 cm×3.5 cm was measured under the condition the same as that of (a), and friction coefficient ($\mu$b) was sought in substantially the same way as above.

(2) Heat Developing Apparatus Processing Property

Using the heat developing apparatus in FIG. 1, the roller 11 above the preliminary heating section A and the roller 13 of the heat developing processing section B were made of silicone rubber (rubber hardness 40 degrees, thickness 1.5 mm); the smooth surface 14 was made of a polytetrafluoroethylene non-woven fabric. A specimen exposed with a 90% mesh image was subject to a heat developing processing under the following conditions in setting the linear velocity rate of the preliminary heating section A to the heat developing processing section B as shown in the below Table, and was evaluated for specimen's conveyance property and processing unevenness.

The clearance between the surface of the roller 13 and the smooth surface 14 in the heat developing processing section B was 0.4 mm. The nip force of the roller pair 12 of the cooling section C was 24 g/cm as a force to convey the image recording material. The heating time in the preliminary heating section A was 11 to 24 sec., and the heating time in the heat developing processing section B was 16 to 28 sec.

Conveyance Property

5: Passed without any scratching scar

4: Passed with slight scratching scars

3: Passed with scratching scars

2: Passed with scratching scars and Took a long time

0: Jammed and not passed.

The grade "4" or higher indicates practically usable level.

Processing Unevenness

5: No processing unevenness

3: Light processing unevenness occurrence

1: Strong processing unevenness occurrence

The grade "4" is the intermediate level between the grade "5" and the grade "3" and the grade "2" is the intermediate level between the grade "3" and the grade "1." The grade "3" or higher indicates practically usable level.

Heat Developing Condition

1) Preliminary heating section A (heating roller's temperatures where the feeding roller pairs 11 are set as No. 1 to No. 6 from the upstream side.)

| | | |
|---|---|---|
| Feeding roller pairs 11 | No. 1 | 75° C. (±0.5° C.) |
| | No. 2 | 90° C. (±0.5° C.) |
| | No. 3 | 105° C. (±0.5° C.) |
| | No. 4 | 117° C. (±0.5° C.) |
| | No. 5 | 121° C. (±0.5° C.) |
| | No. 6 | 121° C. (±0.5° C.) |

2) Heat developing processing section B (plate heaters' temperatures located on the upper side and lower side where the heaters 15 are set as No. 1 to No. 3 from the upstream side.)

| | |
|---|---|
| Heater 15 | No. 1 Upper/Lower = 122° C./122° C. |
| | No. 2 Upper/Lower = 122° C./122° C. |
| | No. 3 Upper/Lower = 122° C./122° C. |

(any is ± 0.3° C.).)

The obtained results are shown in the following Table. As apparent from the following Table, with the linear velocity rate of the preliminary heating section A to the heat developing processing section B of the invention, images can be obtained with good conveyance property and developing processing unevenness.

TABLE 8

| Sample No. | Friction coefficient $\mu e$ | $\mu b$ | $\mu e/\mu b$ | Linear velocity (mm/sec) Preliminary heating section A | Heat developing processing section B | Linear velocity ratio A/B (%) | Conveyance property | Processing unevenness |
|---|---|---|---|---|---|---|---|---|
| 1 | 2.80 | 0.20 | 14.0 | 14.93 | 15.00 | 99.5 | 4 | 5 |
| 2 | 2.80 | 0.20 | 14.0 | 14.85 | 15.00 | 99.0 | 5 | 5 |
| 3 | 2.80 | 0.20 | 14.0 | 14.70 | 15.00 | 98.0 | 5 | 5 |
| 4 | 2.80 | 0.20 | 14.0 | 14.40 | 15.00 | 96.0 | 4 | 4 |
| 5 | 2.80 | 0.20 | 14.0 | 19.94 | 20.00 | 99.7 | 4 | 5 |
| 6 | 2.80 | 0.20 | 14.0 | 19.90 | 20.00 | 99.5 | 5 | 5 |
| 7 | 2.80 | 0.20 | 14.0 | 19.80 | 20.00 | 99.0 | 5 | 5 |
| 8 | 2.80 | 0.20 | 14.0 | 19.40 | 20.00 | 97.0 | 5 | 5 |
| 9 | 2.80 | 0.20 | 14.0 | 19.00 | 20.00 | 95.0 | 4 | 4 |
| 10 | 2.80 | 0.20 | 14.0 | 24.93 | 25.00 | 99.7 | 5 | 5 |
| 11 | 2.80 | 0.20 | 14.0 | 24.88 | 25.00 | 99.5 | 5 | 5 |
| 12 | 2.80 | 0.20 | 14.0 | 24.75 | 25.00 | 99.0 | 5 | 5 |
| 13 | 2.80 | 0.20 | 14.0 | 24.50 | 25.00 | 98.0 | 5 | 5 |
| 14 | 2.80 | 0.20 | 14.0 | 29.91 | 25.00 | 99.7 | 5 | 5 |
| 15 | 2.80 | 0.20 | 14.0 | 29.86 | 25.00 | 99.5 | 5 | 5 |
| 16 | 2.80 | 0.20 | 14.0 | 29.70 | 25.00 | 99.0 | 5 | 5 |

Conveyance property: rate of passing sheet number to processed sheet number

EXAMPLE 3

A specimen having friction coefficient ($\mu b$) as shown in Table below was produced in changing the coating amount of the lubricant A of the back layer (3) of Example 2. As a result that the heat developing apparatus processing property was evaluated in substantially the same way as Example 2 in changing the smooth surface 14 in the heat developing apparatus in FIG. 1 to an aromatic polyamide non-woven fabric, the effect of the invention was turned out as improved because the specimen having the friction coefficient ($\mu b$) between the back surface of the heat developable image recording material and the smooth surface of the heat developing processing section of 1.0 or lower has good conveyance property and can obtain images without processing unevenness.

TABLE 9

| Sample No. | Friction coefficient $\mu e$ | $\mu b$ | $\mu e/\mu b$ | Linear velocity (mm/sec) Preliminary heating section A | Heat developing processing section B | Linear velocity ratio A/B (%) | Conveyance property | Processing unevenness |
|---|---|---|---|---|---|---|---|---|
| 17 | 2.80 | 1.25 | 2.54 | 14.85 | 15.00 | 99.0 | 4 | 3 |
| 18 | 2.80 | 1.00 | 2.80 | 14.85 | 15.00 | 99.0 | 5 | 4 |
| 19 | 2.80 | 0.82 | 3.41 | 14.85 | 15.00 | 99.0 | 5 | 5 |
| 20 | 2.80 | 0.61 | 4.59 | 14.85 | 15.00 | 99.0 | 5 | 5 |
| 21 | 2.80 | 0.43 | 6.51 | 14.85 | 15.00 | 99.0 | 5 | 5 |
| 22 | 2.80 | 1.25 | 2.54 | 19.80 | 20.00 | 99.0 | 4 | 3 |
| 23 | 2.80 | 1.00 | 2.80 | 19.80 | 20.00 | 99.0 | 5 | 4 |
| 24 | 2.80 | 0.82 | 3.41 | 19.80 | 20.00 | 99.0 | 5 | 5 |
| 25 | 2.80 | 0.61 | 4.59 | 19.80 | 20.00 | 99.0 | 5 | 5 |
| 26 | 2.80 | 0.43 | 6.51 | 19.80 | 20.00 | 99.0 | 5 | 5 |

EXAMPLE 4

Specimens were produced in substantially the same way as specimen numbers 2 to 6, 8 to 12 in Examples 1 to 3 in the specification of Japanese Patent Application No 10-346561. As a result that the heat developing apparatus processing property was evaluated under the same condition of the specimen numbers 5 to 9 of example 2 of the invention, the conveyance property was good as well as Example 2, and images could obtained without processing unevenness.

EXAMPLE 5

In specimen No. 7 of Example 2, the clearance between the roller 13 of the heat developing processing section B and the smooth surface 14 of the heat developing apparatus in FIG. 1 was changed as shown in Table below, and the nip force of the feeding roller pair 12 of the cooling section C was adjusted to 25 g/cm as conveyance force to evaluate the conveyance property and the processing unevenness in the same way as Example 2. The processing unevenness was evaluated in the same way as Example 2, and the conveyance property was evaluated by rates of the passing sheet number in the processed sheet number (50 sheets). The result were shown in Table below. As apparent from Table below, where the clearance between the roller and the smooth surface of the heat developing processing section was 0.0 to 1.0 mm, the conveyance property and the heat developing processing were without unevenness and very good.

TABLE 10

| Sample No. | Clearance between roller 13 and smooth surface 14 of the heat developing processing section B (mm) | Conveyance property (%) | Processing unevenness |
|---|---|---|---|
| 27 | −0.2 | 98 | 5 |
| 28 | −0.1 | 99 | 5 |
| 29 | 0.0 | 100 | 5 |
| 30 | 0.5 | 100 | 5 |
| 31 | 1.0 | 100 | 5 |
| 32 | 1.5 | 100 | 4 |
| 33 | 2.0 | 100 | 4 |
| 34 | 2.5 | 100 | 3 |

What is claimed is:

1. A heat developing method for heat developable image recording material, said method comprising the steps of:

(a) subjecting a polyester biaxially drawn and crystallized with orientation to a thermal relaxation processing at a temperature in the range from 130° C. through 200° C. at a conveyance tension of 7 kg/cm$^2$ or lower to prepare a support;

(b) forming an image forming layer and a protection layer using a polymer latex as a binder on one side of the support;

(c) forming a back layer using a polymer latex as a binder on the other side of the support;

(d) preparing at least two heaters for providing heating processing at a prescribed temperature to the heat developable image recording material disposed in line in a conveyance direction of the heat developable image recording material, at least one of said heaters being a top heater disposed above a conveyance path of the heat developable image recording material and at least one of said heaters being a bottom heater disposed below a conveyance path of the heat developable image recording material;

(e) conveying the heat developable image recording material and sliding the heat developable image recording material over a surface of a bottom heater; and (f) thermally processing both sides of the heat developable image recording material by pressing at least a part of the heat developable image recording material during conveyance against a surface of the bottom heater and by subjecting said material to heat from said top and bottom heaters.

2. The heat developing method for heat developable image recording material according to claim 1, wherein the pressing means is a plurality of pressing rollers disposed on the surface of the heater.

3. The heat developing method for heat developable image recording material according to claim 2, wherein the pressing roller is coupled to a rotary driving means and serves as the conveying means for sliding the heat developable image recording material on the surface of the heater.

4. The heat developing method for heat developable image recording material according to claim 3, wherein the pressing rollers rotate at the same predetermined circumferential velocity.

5. The heat developing method for heat developable image recording material according to claim 1, wherein the respective heaters are plate shaped heaters and arranged in a plane.

6. The heat developing method for heat developable image recording material according to claim 1, wherein the respective heaters have a fluororesin coated surface in contact with the heat developable image recording material or have a processing sheet made of a fluororesin and disposed at the heaters.

7. A heat developing method according to claim 1 processing, with a heating developing apparatus having a preliminary heating section and a heat developing processing section, a heat developable image recording material having on a support at least one image forming layer and at least one protection layer formed on the image forming layer, the method comprising, to make a developing processing, the steps of:

conveying the heat developable image recording material by opposing rollers in the preliminary heating section;

contacting a surface on a side having the image forming layer to a drive roller in the heat developing processing section; and conveying the heat developable image recording material by sliding the back surface located oppositely to the side having the image forming layer in contact with a smooth surface, wherein a linear velocity rate of the preliminary heating section to the heat developing section is equal to or lower than 99.9% and equal to or higher than 95.0%.

8. The heat developing method for heat developable image recording material according to claim 7, wherein the developing processing is made with the linear velocity of 10 to 40 mm/sec.

9. The heat developing method for heat developable image recording material according to claim 7, wherein the heat developing apparatus has a rubber roller, in contact with the surface on the side having the image forming layer, at least whose surface is made of a rubber having rubber hardness of 50 degrees or below.

10. The heat developing method for heat developable image recording material according to claim 9, wherein the roller at least has a surface made of a silicone rubber.

11. The heat developing method for heat developable image recording material according to claim 7, wherein the smooth surface of the heat developing processing section of the heat developing apparatus in contact with the back surface located oppositely to the side having the image forming layer is formed of a non-woven fabric made of aromatic polyamide or polytetrafluoroethylene.

12. The heat developing method for heat developable image recording material according to claim 7, wherein a clearance between the smooth surface in contact with the surface located oppositely to the side having the image forming layer during conveyance of the heat developable image recording material and the surface of the drive roller in contact with the surface located on the side having the image forming layer during conveyance of the heat developable image recording material is of 0 to 2 mm.

13. A heat developable image recording material processed by the heat developing method for heat developable image recording material according to claim 1 having, at a temperature when heat development is processed, a ratio of a friction coefficient between the surface on the side having the image forming layer and the roller surface of the heat developing processing section to a friction coefficient between the back surface located oppositely to the side having the image forming layer and the smooth surface of the heat developing processing section is set to 1.5 or higher.

14. The heat developable image recording material according to claim 13, wherein the friction coefficient between the back surface located oppositely to the side having the image forming layer and the smooth surface of the heat developing processing section is of 1.0 or lower at a temperature when heat development is processed.

15. The heat developable image recording material according to claim 13, wherein a polymer latex is used for binders in the image forming layer and the protection layer.

16. The heat developable image recording material according to claim 13, further comprising at least one conductive layer having a surface specific resistance of $1\times10^{12}$ Ω or lower under a condition of 25° C., 20% RH on the side oppositely to the image forming layer.

17. The heat developable image recording material according to claim 13, further comprising a back layer on the side opposite to the side having the image forming layer, wherein a polymer latex is used for binder in the back layer.

* * * * *